US009200546B2

(12) United States Patent
Meinig et al.

(10) Patent No.: US 9,200,546 B2
(45) Date of Patent: Dec. 1, 2015

(54) DEVICE FOR ADJUSTING THE ROTATIONAL ANGULAR POSITION OF A CAM SHAFT

(75) Inventors: Uwe Meinig, Bad Saulgau (DE); Jürgen Bohner, Bad Waldsee (DE); Franz Maucher, Bad Waldsee (DE)

(73) Assignee: Schwabische Huttenwerke Automotive GmbH, Aalen-Wasseralfingen (DE)

( * ) Notice: Subject to any disclaimer, the term of this patent is extended or adjusted under 35 U.S.C. 154(b) by 17 days.

(21) Appl. No.: 13/314,284

(22) Filed: Dec. 8, 2011

(65) Prior Publication Data

US 2012/0145100 A1 Jun. 14, 2012

(30) Foreign Application Priority Data

Dec. 8, 2010 (DE) ..... 10 2010 053 685

(51) Int. Cl.
*F01L 1/34* (2006.01)
*F01L 1/344* (2006.01)
*F01L 1/46* (2006.01)

(52) U.S. Cl.
CPC ..... *F01L 1/3442* (2013.01); *F01L 1/46* (2013.01); *F01L 2001/3443* (2013.01); *F01L 2001/34433* (2013.01); *F01L 2001/34446* (2013.01); *F01L 2001/34456* (2013.01)

(58) Field of Classification Search
CPC . F01L 1/3442; F01L 1/46; F01L 2001/34446; F01L 2001/34456; F01L 2001/3443; F01L 2001/34433
USPC ..... 123/90.15, 90.17
See application file for complete search history.

(56) References Cited

U.S. PATENT DOCUMENTS

| | | | | |
|---|---|---|---|---|
| 7,874,274 | B2 | 1/2011 | Strauss | |
| 8,622,038 | B2 | 1/2014 | Strauss | |
| 2002/0056426 | A1* | 5/2002 | Kobayashi | 123/90.15 |
| 2003/0188704 | A1 | 10/2003 | Aimone | |
| 2005/0274344 | A1* | 12/2005 | Auchter et al. | 123/90.17 |

(Continued)

FOREIGN PATENT DOCUMENTS

| | | | |
|---|---|---|---|
| CN | 101201009 | A | 6/2008 |
| DE | 42 10 581 | A1 | 10/1993 |

(Continued)

OTHER PUBLICATIONS

Office Action for German Patent Application No. 10 2010 053 685.7 dated Aug. 19, 2011.

(Continued)

*Primary Examiner* — Zelalem Eshete
(74) *Attorney, Agent, or Firm* — RatnerPrestia

(57) ABSTRACT

A device for adjusting the rotational angular position of a cam shaft relative to a crankshaft of a combustion engine includes a supply branch for supplying pressure fluid to setting chambers to generate torque acting on a rotor; and a pressure storage device arranged in the supply branch and including a spring and a storage chamber which can be filled with the pressure fluid against a spring force of the spring, wherein the storage chamber begins to fill, against the spring force, at a start-of-filling pressure which is at most as large as a hot idling pressure which the pressure fluid exhibits when the combustion engine is idling in its hot operational state, and continues to be filled against the spring force if the hot idling pressure is exceeded.

23 Claims, 7 Drawing Sheets

(56) References Cited

U.S. PATENT DOCUMENTS

| | | | | |
|---|---|---|---|---|
| 2007/0125331 | A1* | 6/2007 | Finis et al. | 123/90.17 |
| 2008/0283010 | A1* | 11/2008 | Bohner et al. | 123/90.17 |
| 2009/0056656 | A1* | 3/2009 | Strauss | 123/90.17 |
| 2010/0313834 | A1 | 12/2010 | Auchter et al. | |
| 2010/0326383 | A1* | 12/2010 | Auchter et al. | 123/90.15 |
| 2011/0168114 | A1* | 7/2011 | Kobayashi et al. | 123/90.17 |
| 2011/0220046 | A1* | 9/2011 | Welte et al. | 123/90.15 |
| 2012/0103289 | A1* | 5/2012 | Kato et al. | 123/90.15 |

FOREIGN PATENT DOCUMENTS

| | | | |
|---|---|---|---|
| DE | 10 2007 041 552 | A | 3/2009 |
| DE | 10 2007 056 683 | A1 | 5/2009 |
| DE | 10 2009 034 011 | A1 | 4/2010 |
| EP | 0 931 912 | A2 | 7/1999 |
| EP | 1 985 813 | A2 | 10/2008 |
| JP | 10-54215 | | 2/1998 |
| WO | WO 2009/027178 | A1 | 3/2009 |
| WO | WO 2009065730 | A1 * | 5/2009 |
| WO | WO 2009/089984 | A1 | 7/2009 |

OTHER PUBLICATIONS

European Search Report for EP 11 19 1909 mailed Dec. 18, 2012.

Chinese Office Action for CN 201110424132.3 dated Nov. 12, 2013.

* cited by examiner

DEVICE FOR ADJUSTING THE ROTATIONAL ANGULAR POSITION OF A CAM SHAFT

CROSS-REFERENCE TO RELATED APPLICATIONS

This application claims priority to German Patent Application No. 10 2010 053 685.7, filed Dec. 8, 2010. The contents of this application are incorporated herein by reference.

FIELD OF THE INVENTION

The invention relates to a device for adjusting the rotational angular position of a cam shaft relative to a crankshaft of a combustion engine and more specifically to a cam shaft phase setter in combination with a pressure storage means. The pressure storage means is preferably assigned only to the cam shaft phase setter or, optionally, jointly to a plurality of cam shaft phase setters.

BACKGROUND OF THE INVENTION

In order to increase the output and torque, but also to reduce the fuel consumption and exhaust emissions, of internal combustion engines for road vehicles, cam shaft phase setters for varying the inlet and also outlet control times have become widespread. Due to their high degree of reliability, but also in view of a favourable cost-benefit relationship, hydraulic phase setters which are operated by the lubricating oil for the combustion engine in accordance with the principle of the hydraulic pivoting motor have proven to be of value. Increased demands on fuel consumption and emissions require high setting speeds. In order to raise the setting speed, in particular at a low lubricating oil pressure and low oil temperature and a correspondingly high viscosity, EP 1 985 813 A2 provides a pressure storage means in the lubricating oil supply of the phase setter, wherein said pressure storage means ensures a sufficiently high setting pressure for the phase setter, even in operational situations of the combustion engine which are problematic with respect to the hydraulic supply.

EP 0 931 912 B1 provides a valve control comprising a cam shaft and hydraulic force transmission and, for the force transmission, a pressure storage means comprising a storage chamber and a spring member which is arranged in the storage chamber and tensed by the oil pressure when the combustion engine is in operation and held, when tensed, in a positive fit by means of a blocking circuit. When the combustion engine is started, the stop means of the pressure storage means is automatically released, and the spring member relaxes, thus discharging the pressure storage means in the direction of the cam shaft hydraulic force transmission until it has again reached its discharged state. This ensures that a fluid pressure required for the valve control is provided, even when starting the combustion engine.

In accordance with WO 2009/027178 A1, by contrast, a pressure storage means is attuned to the pressure which prevails in the lubricating oil system, such that it is already completely filled with the oil when the hot idling pressure is reached. The "hot idling pressure" usually refers to the oil pressure which prevails in the oil system at the idling rotational speed in the hot operational state of the combustion engine. This configuration is intended to ensure that a locking engagement, which blocks an adjustment of the rotational angular position of the cam shaft relative to the crankshaft, can be released even when the combustion engine is idling.

By contrast, WO 2009/089984 A1 proposes selecting a minimum response pressure of the locking means which is greater than a minimum response pressure of the pressure storage means. The pressure storage means should however still be completely filled with the oil at the hot idling pressure. The intention is to prevent the locking means from being unlocked during the starting phase or in idling phases of the combustion engine.

While the pressure storage means known from EP 0 931 912 B1 is configured to the hydraulic supply immediately as the combustion engine is started, by conserving a high pressure from the operation at a high rotational speed from an earlier operational phase of the combustion engine, the pressure storage means of WO 2009/027178 A1 and WO 2009/089984 A1 are only suitable for absorbing pressure spikes in the starting phase and at most in idling phases of the combustion engine.

SUMMARY OF THE INVENTION

An aspect of the invention provides a cam shaft phase setter comprising a pressure storage means which ensures the reliable operation of the phase setter, even in the event of pressure fluctuations, at a sufficient setting speed.

An aspect of the invention proceeds from a device for adjusting the rotational angular position of a cam shaft relative to a crankshaft of a combustion engine, which comprises a cam shaft phase setter featuring a stator which can be rotary-driven by the crankshaft in a fixed rotational speed relationship, and a rotor which can be rotary-driven by the stator and can be coupled to the cam shaft in order to rotary-drive the cam shaft. When mounted, the stator is rotary-driven by the crankshaft and outputs onto the rotor which is in turn coupled to the cam shaft and thus rotary-drives the cam shaft. The stator can in particular be connected, fixed in terms of torque, to a drive wheel of a traction drive, for example a chain drive, toothed belt drive or toothed wheel drive, wherein the drive wheel is preferably a fixed component of the stator. When mounted, the rotor is connected, fixed in terms of torque, to the cam shaft, i.e. it is configured to be mounted in this way.

The cam shaft phase setter comprises at least one early setting chamber for generating a torque which acts on the rotor relative to the stator in a leading direction, and at least one late setting chamber for generating a torque which acts on the rotor in the opposite rotational direction relative to the stator in a trailing direction. The phase setter preferably comprises a plurality of early setting chambers and a plurality of late setting chambers, in order to distribute the force, necessary for generating the respective torque, evenly around the rotational axis of the rotor and over a larger pressure area. In order to adjust the rotational angular position of the rotor in the early setting direction or leading direction, the at least one early setting chamber or preferably the plurality of early setting chambers jointly can be charged with the pressure fluid, and the at least one late setting chamber or preferably the plurality of late setting chambers can be relieved in relation to the pressure. The reverse applies to adjusting the rotor in the late setting direction or trailing direction. In preferred embodiments, the early setting chamber(s) and late setting chamber(s) can also be reciprocally charged with the pressure fluid by means of a regulating means, such that the rotor can be set in a regulated way not only in one or both of the two end positions—the end position of the early setting and the end position of the late setting—but also in an intermediate rotational angular position which is spaced from both end positions.

The pressure fluid is delivered as a function of the rotational speed of the crankshaft, such that its pressure rises with the rotational speed of the crankshaft. The function can for example be such that the pressure of the pressure fluid effectively follows the rotational speed constantly, in the extreme case continuously; the function can however also be configured such that the pressure of the pressure fluid rises only in discrete increments, in stages, and as applicable in only one stage, as the rotational speed of the crankshaft rises. In preferred embodiments, the pressure fluid is delivered by means of a displacement pump which is driven by the combustion engine as a function of the rotational speed of the crankshaft. The device comprises a supply branch, which is or can be connected to a high-pressure side of a pressure fluid supply system, for supplying the pressure fluid to the setting chambers and a drainage branch, which can be or is connected to a low-pressure side of the pressure fluid system, for draining the pressure fluid from the setting chambers.

The pressure fluid can in particular be a lubricating oil which is used to lubricate the combustion engine. The device can correspondingly be arranged in a lubricating oil supply system of the combustion engine.

The phase setter is assigned a pressure storage means which is arranged in the supply branch of the device, in order to ensure the pressure fluid supply and therefore a setting speed of the phase setter which is appropriate to the operation of the combustion engine, even when there are brief pressure fluctuations in the pressure fluid system. Pressure fluctuations can for example occur during load changes, when the combustion engine is started, or during setting processes of the phase setter or other units which are to be supplied with the pressure fluid. If, during such a pressure fluctuation, the system pressure in the pressure fluid supply upstream of the phase setter and the pressure storage means drops, the pressure storage means supplies the phase setter until either the system pressure upstream of the phase setter and the pressure storage means has again risen above the pressure of the pressure storage means or the pressure storage means has been emptied. The storage volume of the pressure storage means is advantageously at least large enough to ensure, in the event of a drop in pressure, that the phase setter can perform at least one complete setting process, preferably at least two complete setting processes, from one end position to the other.

The pressure storage means comprises a spring means and at least one storage chamber which can be filled with the pressure fluid against a restoring spring force of the spring means. The spring means can be formed by one spring member or can also comprise a plurality of spring members in a suitable spring circuit. The spring member or plurality of spring members can be gas pressure springs, in particular pneumatic springs, or preferably one or more mechanical springs. Pressurised helical springs are particularly suitable.

The pressure storage means comprises a wall structure which delimits the storage chamber and can be moved counter to the spring force in order to charge the pressure storage means and by the spring force in order to discharge the pressure storage means. The filled volume of the storage chamber preferably always corresponds to the equilibrium of the fluid pressure and spring force, such that the pressure storage means can fulfil its equalising function at any time while the combustion engine is in operation, without any delay. The movable wall structure can be an elastically flexible but fluid-proof wall structure or preferably a piston which can be moved back and forth in the pressure chamber. In the first case, the wall structure can be fastened to a chamber wall of the storage chamber. It can form the spring means itself. In such an embodiment, the pressure storage would be a membrane storage comprising an elastic or as applicable merely flexible membrane which in the latter case is tensed by an additional spring member. In preferred embodiments as a piston, the piston is supported on the spring means.

If the wall structure is formed as a piston which can be moved back and forth, first embodiments of the storage chamber can be sealed off over the circumference of the piston solely by a correspondingly narrow gap, without any sealing ring, or however by a sealing ring, preferably a piston ring, or also as applicable by a plurality of sealing rings which are spaced from each other in the direction in which the piston can be moved back and forth. A piston ring is advantageously formed from a material which is similar to the piston in terms of thermal expansion. Thus, the piston can in particular be produced from aluminium or an aluminium-based alloy, and a sealing ring formed as a piston ring, or as applicable a plurality of such sealing rings, can likewise be respectively produced from aluminium or an aluminium-based alloy, wherein if the materials are not exactly the same chemically, the different materials exhibit the same coefficient of thermal expansion or almost the same coefficients of thermal expansion. The sealing ring can be provided with a frictional-reducing coating, at least on its sealing surface which seals the gap, for example a Hardcoat® smooth sliding layer. Such a sliding layer can in particular be produced by anodisation, wherein Hardcoat® smooth electrolytes can consist of a mixture of oxalic acid and additives. Sulphuric acid is generally used.

In accordance with the invention, the pressure storage means is configured such that on the one hand, the storage chamber already begins to fill, against the spring force of the spring means, at a start-of-filling pressure which is at most as large as a hot idling pressure in the supply branch of the pressure fluid supply, but on the other hand continues to be filled against the spring force if the hot idling pressure is exceeded. In preferred embodiments, the start-of-filling pressure is less than the hot idling pressure, such that the filling process begins even below the hot idling pressure and the storage chamber is already partially filled when the hot idling pressure prevails in the supply branch and can fulfil its equalising function in order to provide pressure fluid for the phase setter, if required, in this critical state of the combustion engine. If, in accordance with WO 2009/027178 A1 mentioned at the beginning, the pressure storage means were already completely filled when the supply branch is pressurised to the hot idling pressure, the phase setter would not be able, when the rotational speed of the crankshaft increases, to achieve an adjusting speed which is adapted to the increased rotational speed, since the storage chamber would only resupply pressure fluid at the hot idling pressure. The pressure storage means configured in accordance with the invention, by contrast, resupplies the pressure fluid at a pressure above the hot idling pressure in such a case of need and therefore also ensures a sufficiently rapid adjustment of the phase position of the cam shaft, even at higher rotational speeds of the crankshaft at which, in relation to the number of combustion cycles per unit of time, only a short period of time is available in absolute terms for the adjustment. If, as is preferred, the pressure storage means is arranged downstream of a non-return means, i.e. between the blocking means and the phase setter, it can even be partially charged while the combustion engine is idling hot, when its start-of-filling pressure corresponds to the hot idling pressure, in particular when there are pressure pulsations in the setting chamber or chambers being charged. The pressure storage means can equalise such pressure pulsations at a low rotational speed and in particular also at rotational speeds above the idling rotational speed, such that the phase setter even then operates at an adapted setting speed.

It is advantageous if the pressure storage means is configured—in particular in terms of the volume and cross-sectional area of the storage chamber and the spring force—such that the setting speed, measured in arc degrees per second, at which the rotational angular position of the rotor is adjusted relative to the stator is adapted to the frequency of the combustion cycles of the combustion engine up to at least one and a half times or preferably up to at least twice or even more preferably up to at least three times the idling rotational speed of the combustion engine when there is a drop in pressure in the supply branch, by resupplying from the pressure storage means. In such embodiments, the ratio of the phase setter setting speed and the crankshaft rotational speed is at least substantially constant at least up to one and a half times or twice or preferably up to at least three times the idling rotational speed, even in the event of pressure fluctuations.

The hot idling pressure can be measured in the supply branch of the pressure fluid system immediately upstream of the phase setter or pressure storage means. If, as is preferred, the phase setter and the pressure storage means are separated, by means of a non-return means, from other consumers which are to be supplied with the pressure fluid, such that pressure fluid cannot flow back in the supply branch from the device which comprises the pressure storage means and the phase setter and as applicable one or more other phase setters, the hot idling pressure—which is used as a reference variable—is preferably measured immediately upstream of a shut-off point of the non-return means, otherwise it is advantageously measured upstream of the storage and as near to it as possible. As is usual, the "hot idling pressure" is understood to mean the pressure during idling in the hot operational state of the combustion engine, in which the temperature of the pressure fluid, if it is the lubricating oil, is for example in the range of about 80° to 120° C. Since higher-frequency pressure fluctuations in the supply branch are unavoidable, i.e. pressure fluctuations at a higher frequency than pressure fluctuations which are to be equalised by means of the pressure storage means, the reference variable is understood to be the average value of the pressure which results under such higher-frequency pressure fluctuations. Higher-frequency pressure fluctuations can for example be caused by delivery pulsations of a pump which delivers the pressure fluid or by pipe conduit oscillations. The frequency of these fluctuations is high enough that the pressure is represented by the average value for practical purposes, including that of supplying the device in accordance with the invention. In relation to pressure pulsations due to drag moment fluctuations, which are caused by the cam shaft and act on the phase setter, this can likewise apply to the upper rotational speed range of the crankshaft, while in the lower rotational speed range and preferably also up to at least the middle rotational speed range, such pressure pulsations are advantageously at least partially equalised by the pressure storage means.

In preferred embodiments, the device also comprises a locking means for the phase setter. The locking means can switch between a locking state and a releasing state. In the locking state, it fixes the rotor in a particular rotational angular position relative to the stator mechanically, preferably in a positive fit. It can be charged with the pressure fluid in the locking state, such that when it is charged with the pressure fluid, it switches to the releasing state, which allows the rotational angular position of the rotor to be adjusted, when the pressure of the pressure fluid has reached a minimum unlocking pressure.

In preferred embodiments, the locking means is configured such that the minimum unlocking pressure is at most as large as the hot idling pressure or the start-of-filling pressure. The word "or" is understood here, as elsewhere, by the invention in its usual logical sense of "inclusive or", i.e. it includes both the meaning of "either . . . or" and the meaning of "and", unless only one of these two meanings can follow exclusively from the respectively concrete context. In relation to the minimum unlocking pressure, this means that in a first variant, the minimum unlocking pressure is at most as large as the hot idling pressure and preferably smaller than the hot idling pressure, and in a second variant, the minimum unlocking pressure is at most as large as the start-of-filling pressure and preferably smaller than the start-of-filling pressure. Due to the configuration of the pressure storage means in accordance with the invention, the second variant also includes the "and" meaning of the word "or", since the minimum unlocking pressure is inherently at most as large as the hot idling pressure if the second variant is realised.

If the phase setter comprises the locking means, the latter is preferably likewise connected to the pressure storage means, such that in the event of pressure fluctuations, it is possible to more reliably ensure that the phase setter is unlocked in good time by means of the pressure storage means. If the minimum unlocking pressure is smaller than the start-of-filling pressure, the pressure storage means also does not begin to be filled first, before the locking means is unlocked, which would lead to a delay in unlocking. If, as is preferred, the locking means fixes the rotor in a positive fit in the locking engagement, then not only the pressure force of the pressure fluid leading out of the locking engagement but also a shearing force which points transverse to said pressure force act in the locking engagement. The shearing force depends on the drag moment of the cam shaft, which is rotary-driven via the stator, the locking engagement and the rotor when the locking engagement is established, and also on the pressure ratios in the setting chambers. Unlocking in good time, at a low rotational speed, is correspondingly also desirable in view of an advantageously low shearing force, in particular when the rotor is locked in early setting. Attuning the pressure storage means and the locking means in the way described ensures, in combination, that the phase setter is unlocked in good time but still reliably and the setting speed is sufficient even when the combustion engine is in loaded operation, above the hot idling rotational speed.

In practice, the minimum unlocking pressure can for example be 0.4 to 0.8 bars, the start-of-filling pressure can be correspondingly higher, for example 0.5 to 1.0 bars, and a minimum filling pressure at which the storage chamber is completely filled can for example be 1.5 to 2.5 bars. The hot idling pressure lies correspondingly between the start-of-filling pressure and the minimum filling pressure which is required for completely filling the storage chamber. As already described with respect to the hot idling pressure, the average pressure values which result from the higher-frequency pressure fluctuations are used as representative measured values for the different characteristic pressures. The pressures which are to be compared to each other are expediently measured in stationary operational states of the combustion engine, in which no additional units which can optionally be connected to the pressure fluid supply system are also switched on or off. The phase setter also expediently does not perform any setting process while measurements are being taken.

The rotor is fixed relative to the stator, preferably in an early setting, by means of the locking means. Instead, the locking means could however also be configured to fix the rotor in the locking engagement in the late setting or in an intermediate setting between these two extreme positions. In another variant, the locking means can be configured to fix the rotor relative to the stator in more than just one of the settings mentioned, in a locking engagement in each case.

Charging the locking means with the pressure fluid of the early setting chamber is advantageous for unlocking. Charging the early setting chamber with pressure relieves the locking means, at least partially, from the drag moment of the cam shaft, such that transverse and/or shearing forces which oppose unlocking are reduced as compared to charging the locking means from the late setting chamber. There is reason to believe that the pressure pulsations in the early setting chamber caused by drag moment fluctuations when there is locking clearance in the locking engagement relieve the locking engagement of transverse and/or shearing forces and facilitate or only even then enable unlocking. An increase in the drag moment causes a slight reduction in the size of the early setting chamber via a locking clearance, such that the pressure in the early setting chamber is increased and relieves the locking means in the locking engagement. In preferred embodiments, the locking means is only connected to the early setting chamber in order to release the locking engagement.

Although charging the late setting chamber with pressure loads the locking means with transverse and/or shearing forces in addition to the drag moment of the cam shaft, charging the locking means with the pressure fluid of the late setting chamber has another advantage with regard to unlocking. If late setting is to be performed, i.e. if the late setting chamber is charged with pressure and/or pressure fluid, the pressure in the early setting chamber simultaneously drops due to it being relieved. If charging the locking means with pressure were directly dependent on the pressure from the early setting chamber, it could transpire that the locking means locks even before the rotational angular position of the rotor has been adjusted in relation to the stator, thus preventing the rotational angular position from being adjusted. Charging the locking means with the pressure of the pressure fluid of the late setting chamber thus has the advantage that the locking means is provided with sufficient pressure that it can reliably unlock. In preferred embodiments, the locking means is only connected to the late setting chamber in order to release the locking engagement.

If the locking means is connected to the early setting chamber, in particular only connected to the early setting chamber, a design feature which means that the pressure in the early setting chamber or in the locking means does not suddenly drop if the late setting chamber is charged can for example ensure that the locking means is still unlocked if the rotor is adjusted relative to the stator by applying pressure to the late setting chamber.

If the locking means is connected to the late setting chamber, in particular only connected to the late setting chamber, it is possible to ensure that when the rotor occupies the early setting position at low rotational speeds, for example when the engine is started or idling, the locking means locks due to the drop in pressure in the late setting chamber. If the engine is switched off, it is ensured that the locking means is locked, such that when the engine is started again, it is ensured that the rotor is locked in the early setting position.

The following combinations are for example possible:

1. locking the locking means in the early setting and charging the locking means with pressure from the early setting chamber;
2. locking the locking means in the early setting and charging the locking means with pressure from the late setting chamber;
3. locking the locking means in the late setting and charging the locking means with pressure from the late setting chamber;
4. locking the locking means in the late setting and charging the locking means with pressure from the early setting chamber.

Which of these combinations is particularly advantageous depends on a multitude of parameters such as for example whether the cam shaft phase setter is connected to the input cam shaft which controls the input valves or the output cam shaft which controls the output valves, what output-torque characteristics the engine is supposed to have when idling or at high rotational speeds, or on pressure pulsations, the type of fuel, etc. Any of these combinations is in principle conceivable for the input cam shaft and the output cam shaft.

In preferred embodiments, the locking means comprises a locking spring, preferably a mechanical spring, and a locking element which can be moved back and forth and can be moved out of the locking engagement, against a restoring spring force of the locking spring, and correspondingly into the locking engagement by means of the spring force. The locking element comprises at least one pressure area on which it can be charged with the pressure fluid in order to move the locking element out of the locking engagement into a releasing position and thus transfer the locking means into its releasing state. The locking element can in particular be supported on the rotor via the locking spring and guided by the rotor such that it can be moved back and forth between the locking engagement and the releasing position. In principle, however, it would instead be equally possible for it to be supported on the stator and guided by the stator. The locking element is supported such that it can be moved into and out of the locking engagement, preferably in a direction which leads beyond an axially facing side of the rotor or stator—preferably, as mentioned, on the rotor; in principle, however, it would also be conceivable for the locking element to be able to be moved radially. It is particularly preferably able to be moved axially.

The locking element can be formed as a simple piston comprising only one pressure area for charging with the pressure fluid. In preferred embodiments, the locking element is embodied as a stepped piston and comprises an engaging portion and a guiding portion. In the locking engagement, the engaging portion of the locking element engages with a receptacle. If, as is preferred, the locking element is supported on the rotor, then the stator comprises the receptacle. If the locking element is instead supported, such that it can be moved, on the stator, then the rotor forms the receptacle. The locking element comprises a first pressure area in a transitional region between the engaging portion and the guiding portion. A second pressure area is provided on the engaging portion. The pressure areas can each be charged with the pressure fluid, in order to release the locking engagement. The first pressure area and second pressure area can be fluidically separated from each other, and one of the pressure areas can be connected to the early setting chamber and the other can be connected to the late setting chamber, as is usual in phase setters comprising a stepped locking element, in order to be able to unlock both when charging the early setting chamber with pressure and when charging the late setting chamber with pressure. In preferred embodiments of the invention, by contrast, the first pressure area and the second pressure area are connected to each other such that the pressure fluid passes to one of the pressure areas and from there to the other of the pressure areas in order to release the locking engagement. Combined charging is not performed in such embodiments. The locking means is either connected to the late setting chamber only or, more preferably, to the early setting chamber only; however, both pressure areas are charged simultaneously in accordance with the pressure in the relevant setting chamber. This results in an overall pressure area which is large as compared to the prior art and thus a comparatively larger force available for unlocking, even at a small pressure. The locking spring can therefore exhibit a greater spring resilience than is otherwise usual in stepped pistons or can be installed with a greater bias. The locking spring holds the locking element correspondingly securely until the minimum unlocking pressure is reached in the locking engagement. The pressure areas are preferably connected to each other via a connecting channel which is an internal connecting channel with respect to the locking means, such that the flow resistance within the connection is low. The connecting channel is preferably a channel of the rotor which is an internal channel as viewed geometrically.

In advantageous embodiments, in which the rotor mounts the locking element such that it can be moved, the rotor comprises a connecting channel which is an external channel in relation to the locking means and which ports into one of the setting chambers, such as for example the early setting chamber or preferably the late setting chamber, and connects—preferably, short-circuits—the locking means to said setting chamber in order to release the locking engagement. Preferably, the locking means is connected to the relevant setting chamber only via the rotor. The external connecting channel ports on an external area of the rotor, which delimits the relevant setting chamber. This creates a connection between said setting chamber, which is also referred to in the following as the unlocking setting chamber, and the pressure area or preferably the plurality of pressure areas of the locking element, wherein said connection is short, simple in design and exhibits low hydraulic loss.

The locking element is preferably arranged, such that it can be moved, in a radially projecting vane of the rotor. The connecting channel between the locking means and the unlocking setting chamber can lead over a short path from an internal chamber of the rotor vane, which is delimited by said pressure area of the locking element on one side, up to where it ports on the side area of the rotor vane directly into the unlocking setting chamber, such as for example the early setting chamber or preferably the late setting chamber, preferably as a merely linear channel which does not change direction. The port of the external connecting channel preferably exhibits a distance from each of the two axially facing sides of the rotor, such that the port lies completely within the area of the rotor vane.

When the locking element is arranged in a rotor vane, it is advantageous if the locking element is arranged eccentrically in the circumferential direction as viewed in an axially facing view of the rotor. In relation to a radial with respect to the rotational axis of the rotor, which centrally divides the rotor vane as viewed in the axially facing view, at least the centre of the locking element is not arranged on the radial but rather next to it in the circumferential direction. The locking element is preferably arranged nearer to the unlocking setting chamber, such as for example the early setting chamber or preferably the late setting chamber, in the circumferential direction than to the setting chamber situated on the other side of the rotor vane, preferably the late setting chamber, as viewed in the axially facing view. This is in particular advantageous when the locking means is directly connected to the unlocking setting chamber in order to release the locking engagement. On the axially facing side of the rotor vane, an advantageously long sealing stay is provided between the guide for the locking element and the opposing setting chamber in the circumferential direction.

One feature which can be advantageously realised in combination with arranging the locking element eccentrically in the circumferential direction but can also in principle be realised instead of this is that the locking element is arranged nearer to a radial end of the rotor vane than to the rotational axis. Arranging it near to the radial end likewise helps to reduce the shearing force which makes unlocking more difficult and has already been discussed.

It should also be noted with respect to the arrangement of the locking element in the rotor vane that in the preferred embodiments of the rotor comprising a plurality of vanes, the vane in which the locking element is arranged such that it can be moved is preferably wider as measured in the circumferential direction than the at least one other vane or the plurality of other vanes of the rotor. This creates design space for the locking means and enables a long sealing stay to be embodied on the axially facing side of the rotor, on the side of the locking means facing away from the unlocking setting chamber in relation to the circumferential direction. The distance between the two stator vanes, between which the wider rotor vane protrudes, is advantageously likewise larger, in accordance with the larger vane width, than between the other mutually adjacent pair(s) of stator vanes, preferably by at least substantially the difference in the width of the rotor vanes.

In preferred embodiments, the phase setter and the pressure storage means are jointly arranged in an attachment housing which can be mounted on a machine housing of the combustion engine, for example a main housing or a cylinder head housing of the machine housing. In this way, the phase setter and the pressure storage means can be mounted as a unit on the combustion engine by mounting the attachment housing. If the phase setter and the pressure storage means are separated from the rest of the pressure fluid supply system by means of a non-return means, i.e. in relation to flowing back through the supply branch, then the non-return means can advantageously also be arranged in the attachment housing. Irrespective of whether the phase setter and pressure storage means are arranged in a common attachment housing or arranged in an attachment housing at all, the non-return means is preferably only assigned to the phase setter or as applicable a plurality of phase setters for a plurality of cam shafts, i.e. it specifically secures only the phase setter or as applicable a plurality of phase setters against the possibility of pressure fluid flowing back through the supply branch if the pressure immediately upstream of the non-return means is smaller than the pressure downstream. The pressure storage means is preferably likewise arranged, together with the phase setter and directly assigned to it, downstream of the non-return means, i.e. in the fluid flow between the non-return means and the phase setter.

In one development, a mounting side of the attachment housing via which the attachment housing is fastened to the combustion engine, preferably the machine housing, has a gasket arranged on it which is produced separately from the attachment housing and is held on the attachment housing by means of at least one centring element which is used to simply and correctly position the attachment housing relative to the combustion engine when the attachment housing is mounted. The gasket is preferably held on the attachment housing at a plurality of such centring elements of the attachment housing. The gasket can be held on the attachment housing in a frictional fit, but is preferably held in a positive fit or in a way which at least involves a positive fit, by gripping behind the at least one centring element or preferably gripping behind each of a plurality of centring elements. The centring element(s) can in particular protrude on a joining area of the attachment housing which is located on the mounting side. The joining area of the attachment housing on which the centring element or elements project(s) or alternatively is/are formed as a recess or as recesses, is an area via which the attachment housing is tensed against the combustion engine when mounted, preferably by means of a screw connection. It can in particular be an axially facing area which surrounds a rotational axis of the stator-rotor arrangement. The gasket is preferably held captively, i.e. embodied such that the gasket remains in the position relative to the attachment housing which is suitable for mounting, even when the attachment housing is held with the mounting side pointing freely downwards. The at least one centring element used to hold the gasket or at least one of a plurality of centring elements used to hold the gasket can comprise a passage and for example be formed as a sleeve, wherein the passage is large enough to be able to guide a screw for a screw connection to the combustion engine or a bolt-shaped tensing element of another joining connection through such a hollow centring element. The Applicant reserves to right to direct a separate claim to an attachment housing for the phase setter or the pressure storage means, in particular an attachment housing for the phase setter and the pressure storage means, comprising a gasket held in this way. In general terms, however, holding the gasket is also advantageous with regard to connecting a housing used for other purposes or other unit on the combustion engine.

As already mentioned, the rotor and the stator form a hydraulic pivoting motor in preferred embodiments. In such an embodiment, the rotor and the stator can be arranged with an internal axle with respect to each other and can each comprise at least one radially projecting vane. The rotor can in principle be a hollow wheel comprising at least one inwardly projecting vane, and the stator can in principle be an internal wheel comprising at least one vane which projects radially outwards; preferably, however, the stator forms the hollow wheel and comprises at least one and preferably a plurality of inwardly protruding vanes, and the rotor forms the internal wheel which comprises at least one and preferably a plurality of outwardly protruding vanes. The rotor vane or vanes and the stator vane or vanes delimit the setting chambers in the circumferential direction. If the early setting chamber is charged with pressure fluid, this generates a force which acts in the circumferential direction and therefore a torque which acts on the rotor in the early setting direction or leading direction as viewed relative to the stator. The conditions are reversed if the late setting chamber is charged with the pressure fluid and the early setting chamber is relieved.

If, as is preferred, the phase setter is operated using the lubricating oil for the combustion engine, the lubricating oil can be guided from the cam shaft to the phase setter and pressure storage means or via the pressure storage means to the cam shaft and from the cam shaft to the phase setter. In principle, however, the lubricating oil need not be guided to the phase setter via the cam shaft, but can also be supplied to the phase setter in other ways. In first embodiments, the pressure fluid is guided to the phase setter via the pressure storage means, i.e. the pressure fluid flows into the storage chamber and is only supplied to the phase setter and/or the setting chambers via the storage chamber. In the first embodiments, the pressure storage means is arranged in the main flow. In second embodiments, the setting chambers and the pressure storage means are arranged in parallel in relation to the fluid flow, wherein on the flow path of the pressure fluid to the setting chamber or chambers, a diversion leads to the pressure storage means. In the second embodiments, the pressure storage means is arranged in the secondary flow in relation to the main flow which leads to the phase setter. The main flow to the device in accordance with the invention is preferably arranged parallel to the supply flow, for example to cylinders of the combustion engine or bearings of the cam shaft and the like, such that the pressure fluid flows to the device with little loss.

Embodiments in which the phase setter comprises a control valve for controlling the pressure in the setting chambers, wherein said control valve is centrally arranged in relation to the stator-rotor arrangement, preferably at one end of the cam shaft, and preferably also centrally arranged in relation to the rotational axis of the cam shaft, for example completely or partially in a hollow end of the cam shaft, have proven particularly advantageous. In such embodiments, the pressure fluid is preferably guided to the control valve via the cam shaft and supplied from the control valve to the early setting chamber(s) or late setting chamber(s) in accordance with the desired relative rotational angular position.

The present invention is directed to attuning the pressure storage means to the hot idling pressure such that the start-of-filling pressure is at most as large as the hot idling pressure and the minimum filling pressure for completely charging is greater than the hot idling pressure. It should however be pointed out that other inventive concepts described in connection with this inventive concept can be advantageously used even without this basic concept. The Applicant for example reserves the right to direct a separate application to a device in accordance with Features (a) to (e), which contains the features of Claim 2 instead of Features (f) and (g), i.e. which is directed to attuning the minimum unlocking pressure and the start-of-filling pressure. A device comprising only Features (a) to (d) and the features of Claim 4, i.e. connecting the locking means to preferably the late setting chamber or the early setting chamber, can also be the subject of a divisional application. Another independent subject, which need not necessarily be combined with Features (e) to (g) of Claim 1, is that of embodying the locking element as a stepped piston and charging the resultant plurality of at least two pressure areas with the same pressure fluid, preferably the pressure fluid from the early setting chamber or the pressure fluid intended for the early setting chamber(s). Yet another independent subject is formed by arranging the locking element eccentrically in relation to the circumferential direction in a rotor vane. This inventive concept can also in principle be realised without Features (e) to (g) of the claim. A pressure storage means which can advantageously be embodied as per at least one aspect of the invention claimed here in relation to the pressure levels such as the start-of-filling pressure, the hot idling pressure, the minimum filling pressure for complete filling and the minimum unlocking pressure is however also preferably provided in each of such embodiments.

BRIEF DESCRIPTION OF THE DRAWINGS

Example embodiments of the invention are described below on the basis of figures. Features disclosed by the example embodiments, each individually and in any combination of features, advantageously develop the subjects of the claims and also the embodiments described above. There is shown:

DETAILED DESCRIPTION OF THE INVENTION

Figure 1:
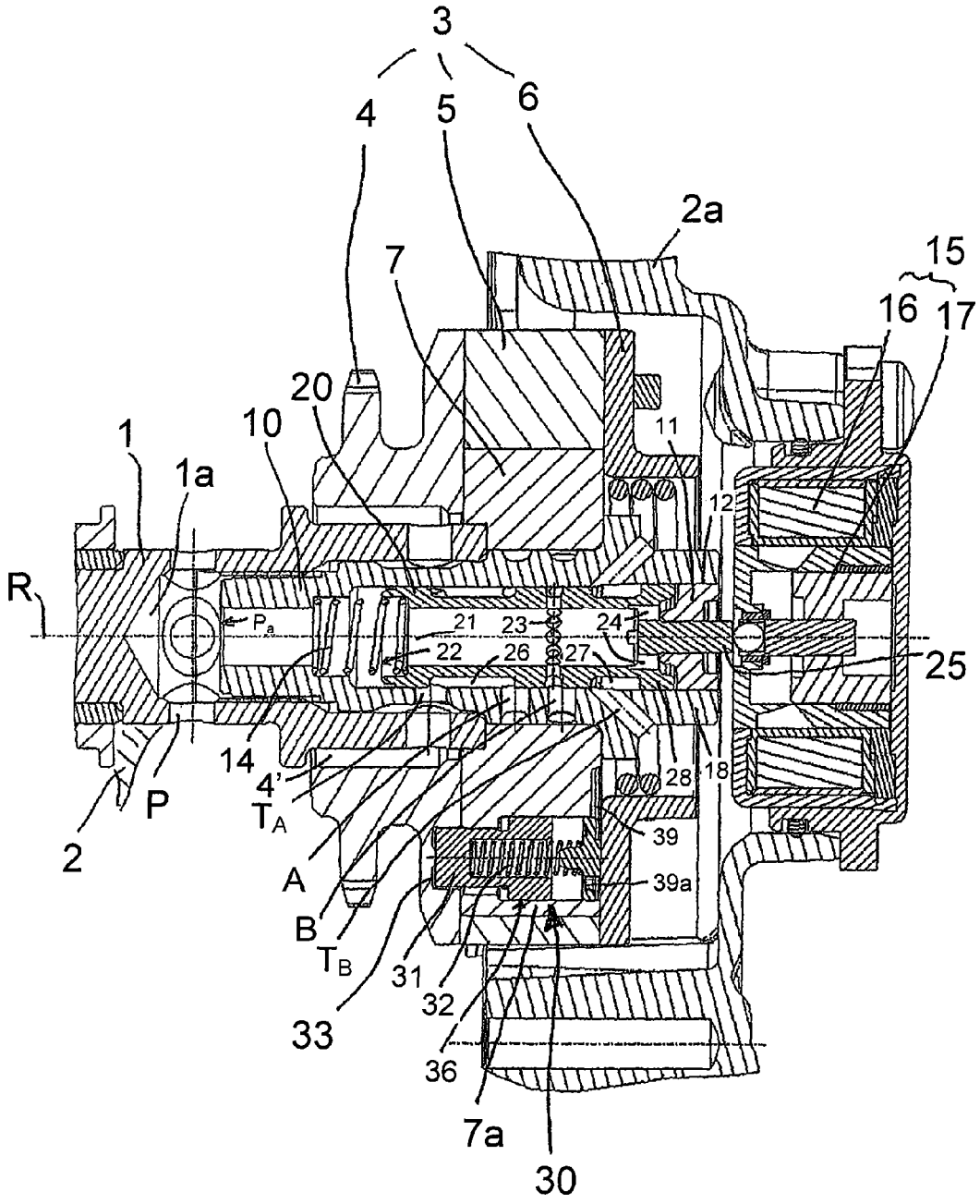
FIG. 1 a cam shaft phase setter, in a locked state.

FIG. 1 shows a cam shaft phase setter in a longitudinal section. The cam shaft phase setter is arranged at an axially facing end of a cam shaft 1 and is used to adjust the phase position, i.e. the rotational angular position, of the cam shaft 1 relative to a crankshaft of a combustion engine, for example a drive motor of a motor vehicle. The cam shaft 1 is mounted in a machine housing 2 of the combustion engine, for example in a cylinder head housing, such that it can be rotated about a rotational axis R.

The cam shaft phase setter comprises a stator 3 which can be rotary-driven by the crankshaft, and a rotor 7 which can be non-rotationally connected to the cam shaft 1. The stator 3 is composed of a drive wheel 4, for example a sprocket, a cover 6 and an impeller 5 which is axially arranged between the drive wheel 4 and the cover 6. The drive wheel 4, the impeller 5 and the cover 6 are non-rotationally connected to each other. The assembly of the stator 3 is merely an example. The stator 3 can alternatively also be joined from more parts or, instead of the three parts 4, 5 and 6, can also be joined from only two parts, for example from an integrated part 4, 5 and the part 6 or from the part 4 and an integrated part 5, 6. It can in principle also be originally formed in one piece. The drive wheel 4 can be formed circumferentially on the outside of the impeller 5, and the cover region of the drive wheel 4, which laterally seals off the stator-rotor arrangement, can be a component of the rotor 7. In addition to or instead of the cover region formed by the drive wheel 4, the cover 6 can be a component of the rotor 7. The stator 3 and the rotor 7 form a hydraulic pivoting motor.

Figure 3A:
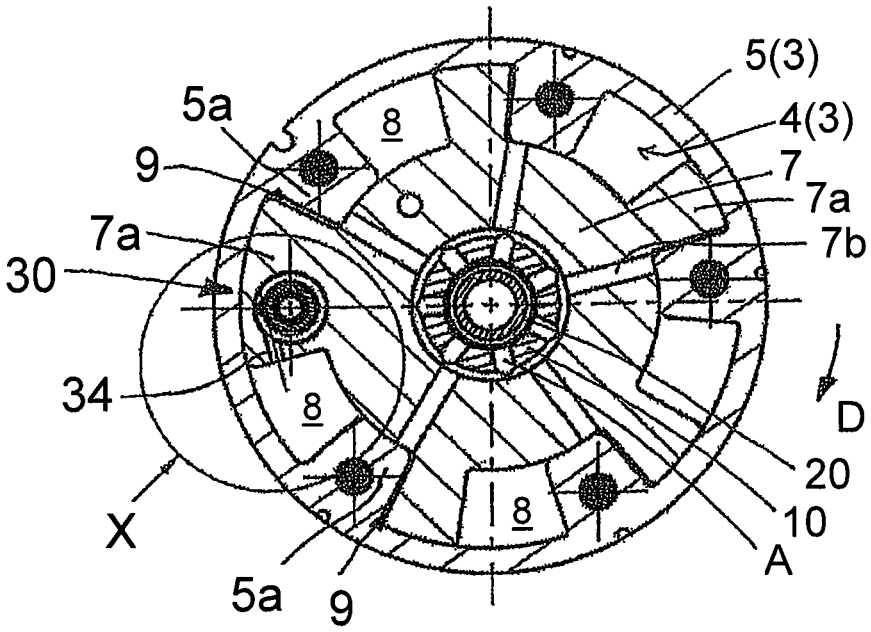
FIG. 3*a* the phase setter in a cross-section.
Figure 3B:
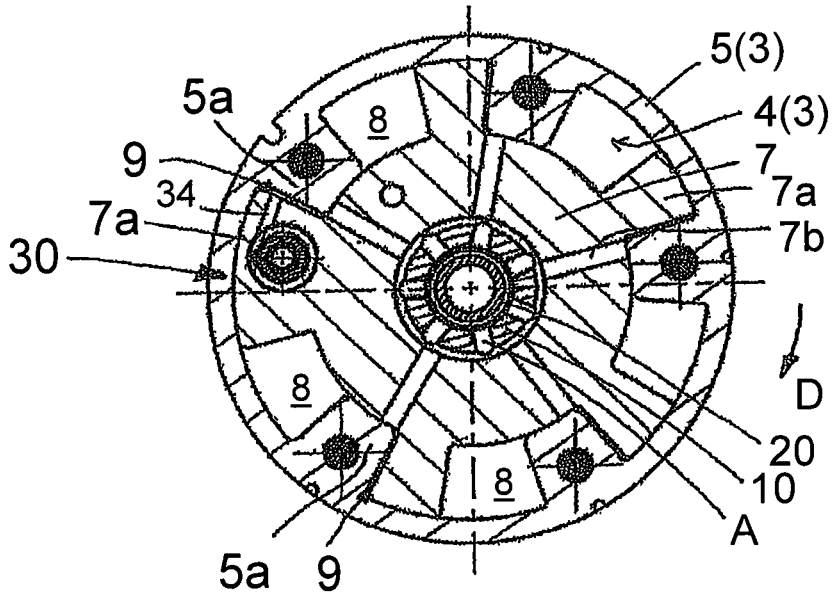
FIG. 3*b* a modification of the phase setter from FIG. 3*a*, in a cross-section.

FIGS. 3*a* and 3*b* show the stator-rotor arrangement 3, 6 in a cross-section. The impeller 5 forms an external component of the pivoting motor, and the rotor 7 forms an internal component of the pivoting motor. The internal circumference of the hollow impeller 5 comprises vanes 5*a* which project radially inwards. The rotor 7 comprises vanes 7*a* which project radially outwards and form first setting chambers 8 and second setting chambers 9 with the vanes 5*a* of the stator 3. The setting chambers 8 are respectively arranged on one side of the vanes 7*a* of the rotor 7 in the circumferential direction, and the setting chambers 9 are respectively arranged on the other side of the vanes 7*a* of the rotor 7 in the circumferential direction. If the setting chambers 8 are pressurised and the setting chambers 9 are relieved, the rotor 7 rotates relative to the stator 3, clockwise in FIGS. 3*a* and 3*b*, at most up to the end position occupied in FIGS. 3*a* and 3*b*. If the setting chambers 9 are pressurised and the setting chambers 8 are relieved of pressure, the rotor 7 rotates anti-clockwise. The rotational movement relative to the stator 3 in one rotational direction corresponds to the cam shaft 1 leading relative to the crankshaft, and the relative rotational movement in the other direction corresponds to the cam shaft 1 trailing relative to the crankshaft.

In the example embodiment, the setting chambers 8 are early setting chambers and the setting chambers 9 are late setting chambers. In FIGS. 3*a* and 3*b*, the rotor 7 occupies the early setting relative to the stator 3, in which the cam shaft 1 leads relative to the crankshaft. If, instead, the late setting chambers 9 are charged with the pressure fluid and the early setting chambers 8 are relieved, the rotor 7 rotates in the trailing direction, at most up to a late setting. The early setting and the late setting are each predefined by an abutting contact. In the two end settings or extreme settings, at least one of the rotor vanes 7*a* is respectively in an abutting contact with one of the stator vanes 5*a*. In preferred embodiments, the rotor 7 can not only be rotationally adjusted back and forth relative to the stator 3 between these two rotational angular end positions but rather can be hydraulically fixed in any intermediate position by correspondingly charging both the early setting chambers 8 and the late setting chambers 9 with pressure.

The cam shaft phase setter comprises a control valve which is arranged centrally in relation to the stator-rotor arrangement 3, 7 and comprises a valve housing 10 and a valve piston 20 which is arranged in the valve housing 10 such that it can be axially adjusted back and forth (FIG. 1). The valve piston 20 is hollow and comprises an axially extending hollow space 21, a piston inlet 22 at one axial end and a piston outlet 23 which leads radially through a casing of the valve piston 20 which surrounds the hollow space 21. The other axial end of the valve piston 20, which faces away from the piston inlet 22, comprises a coupling member 25 for coupling to a setting member 15 which axially adjusts the valve piston 20. The coupling member 25 acts as an operating plunger of the valve piston 20. The coupling member 25 can be formed in one piece with the piston casing which surrounds the hollow space 21 or as applicable can be joined, axially fixed, to it. It projects on the axially facing end of the valve piston 20 which axially faces the setting member 15. The coupling member 25 protrudes through an axially facing closure wall 11 of the valve housing 10. The axially facing closure wall 11 surrounds the coupling member 25 in a tight fit and thus ensures a fluid-proof closure of the valve housing 10 despite the coupling member 25 being able to be moved back and forth.

The setting member 15 is an electromagnetic setting member—in the example embodiment, an axial stroke electromagnet—comprising a coil 16 through which current can be passed and an anchor 17 which the coil 16 surrounds. The coil 16 is non-rotationally connected to the machine housing 2 of the combustion engine. In the example embodiment, the coil 16 is non-rotationally connected to a cover 2*b* which is in turn fixedly connected to an attachment housing part 2*a* which is mounted on the machine housing 2. The anchor 17 can be axially moved relative to the coil 16. The anchor 17 and the coupling member 25 are directly in a coupling engagement which is formed as an axial pressure contact. When current is passed through the coil 16, a setting force which is directed axially towards the coupling member 25 acts on the anchor 17 and—in the coupling engagement which is solely an axial pressure contact—on the coupling member 25 and therefore on the valve piston 20. Preferably, only a point contact prevails at the separation point between the valve piston 20, which rotates with the cam shaft 1 during operation, and the setting member 15 which does not rotate. The end of the anchor 17 which contacts the coupling member 25 preferably exhibits a spherical surface. Alternatively, the axially facing end of the coupling member 25 could exhibit a spherical surface. In one development, the contact end of the anchor 17 is formed as a spherical slide bearing, by mounting a sphere at the contact end in a socket of the anchor 17, such that it can be freely and spherically rotated.

The control valve comprises a spring member 14, the spring force of which opposes the setting force of the setting member 15. The spring member 14 is directly supported on the valve housing 10 and supported in the direction of the setting member 15 on the valve piston 20. The setting member 15 is actuated, i.e. current is passed through it, by a controller of the combustion engine. It is preferably actuated using a characteristic diagram which is stored in a memory of the machine controller, for example as a function of the rotational speed of the crankshaft, the load or other and/or additional parameters which are relevant to the operation of the combustion engine.

The valve piston 20 is arranged in a central axial hollow space of the valve housing 10, such that it can be moved back and forth in the way described. Its axial end which faces away from the axially facing closure wall 11 comprises a housing inlet $P_a$ which leads axially and centrally into the hollow space of the housing and to which pressurised fluid can be supplied via the cam shaft 1, i.e. via a pressure inlet P of the cam shaft 1. The fluid can in particular be a lubricating oil which is used to lubricate the combustion engine and also to lubricate for example the pivot bearing of the cam shaft 1. The pressure fluid is supplied to the control valve, for example by the pivot bearing of the cam shaft 1 as is preferred, i.e. the pressure port P is connected to the lubricating oil supply for the pivot bearing. This pressure fluid flows into the cam shaft 1 at P, through the axial housing inlet $P_a$ into the valve housing 10, and through the piston inlet 22 which is axially flush with the housing inlet $P_a$, into the hollow space 21. A piston outlet 23 branches laterally off from the hollow space 21, for example in the radial direction as is preferred, and the pressure fluid is supplied through the piston outlet 23 to either the early setting chambers 8 or the late setting chambers 9 as a function of the axial position of the valve piston 20, in order to set the phase position of the rotor 7 relative to the stator 3 and thus the phase position of the cam shaft 1 relative to the crankshaft. The piston outlet 23 is formed by radial passages through the casing of the valve piston 20 which are arranged in a distribution over the circumference of the valve piston 20. The piston outlet 23 is arranged in an axially middle portion of the valve piston 20.

The valve housing 10 comprises ports, which lead through its casing, for supplying and draining the fluid to and from the setting chambers 8 and 9. These include an operating port A and an operating port B, a reservoir port $T_A$ which is assigned to the operating port A, and a reservoir port $T_B$ which is assigned to the operating port B. The ports A to $T_B$ are each linear passages through the casing of the valve housing 10. The ports A, B and $T_A$ extend radially through the casing by the shortest path. The reservoir port $T_B$ extends obliquely outwards into the phase setter housing 2*a*. The operating port B of the valve housing 10 is formed by radially extending and therefore short passages through the casing of the valve housing 10 which are arranged in a distribution over the circumference of the valve housing 10. The ports A, $T_A$ and $T_B$ are likewise each formed by a plurality of passage channels which are arranged in a distribution around the central axis R.

FIG. 1 shows the valve piston 20 in a first axial piston position in which it is held by the spring member 14. In the first piston position, the piston outlet 23 is connected to the operating port B. The pressure fluid which is supplied to the cam shaft 1 via the pressure port P flows in the axial direction through the axial housing inlet $P_a$ and the piston inlet 22 into the hollow space 21 of the valve piston 20 and from there through the branching piston outlet 23 to the setting chambers 8 which in accordance with the representation in FIG. 1 are assigned to the operating port B. The setting chambers 9 which are connected to the operating port A are connected to the reservoir port $T_A$ via the operating port A and a recess 26 formed on the external circumference of the valve piston 20, and to the reservoir via the reservoir port $T_A$ and a feedback 4' which rotates with the cam shaft 1, and are thus relieved of pressure. The recess 26 extends circumferentially 360° over the external circumference of the valve piston 20. Behind the piston outlet 23, as viewed in the axial direction from the recess 26, another axially extending recess 27 is formed on the external circumference of the valve piston 20 and likewise extends circumferentially over the external circumference of the valve piston 20. The recess 27 is connected to the reservoir port $T_B$ in the first piston position. The reservoir port $T_B$ is assigned to the operating port B. However, it is fluidically separated from the operating port B in the first piston position by means of a sealing stay of the valve piston 20 which is formed between the piston outlet 23 and the recess 27.

If the anchor 17 is charged with a setting force which exceeds the spring force of the spring member 14 by correspondingly passing current through the setting member 15, the setting member 15 pushes the valve piston 20 out of the first piston position shown, axially towards the housing inlet $P_a$ and, if the setting force is correspondingly large, up to an axially second piston position in which it is no longer the operating port B but rather the other operating port A which is connected to the piston outlet 23. In the second piston position, a sealing stay of the valve piston 20 which is formed between the piston outlet 23 and the recess 26 separates the operating port A from its assigned reservoir port $T_A$, such that in the second piston position, the setting chambers 9 are charged with the pressure fluid. In the second piston position, the recess 27 also connects the operating port B to the reservoir port $T_B$, such that the fluid can flow off from the setting chambers 8 and the setting chambers 8 are relieved of pressure. The rotor 7 is correspondingly moved, anti-clockwise in the representation in FIG. 2, relative to the impeller 5 and thus relative to the stator 3. The cam shaft 1 which is non-rotationally connected to the rotor 7 is adjusted in its phase position relative to the crankshaft by the same rotational angle.

The fluid of the high-pressure side which flows through the housing inlet $P_a$ into the control valve charges the valve piston 20 with a first axial force which acts in the direction of the setting member 15. In order to compensate for this first axial force, fluid can flow through the valve piston 20 towards the setting member 15, such that a fluid pressure builds up on its rear side which faces the setting member 15, between said rear side and the axially facing closure wall 11, wherein said fluid pressure exerts a counterforce—a second axial force—on the rear side of the valve piston 20. Since the projection area which can be charged with the pressure fluid is reduced by the cross-sectional area over which the coupling member 25 protrudes through the axially facing closure wall 11, the axial counterforce—the second axial force—would be smaller than the first axial force, in accordance with the cross-sectional area of the coupling member 25. A resultant axial thrust would arise which would change as a function of the pressure of the fluid in accordance with the difference between the projection areas. The characteristic curve of the control valve would correspondingly change, which can lead to significant distortions, since the pressure of the fluid can fluctuate while the combustion engine is in operation.

In order to increase the second axial force, the valve piston 20 comprises a radially widened piston portion 28, referred to in the following as the widening 28, and the valve housing 10 comprises a complementarily widened housing portion 18 which surrounds the widening 28 in a tight fit. Providing the valve housing 10 and the valve piston 20 co-operate in a seal, the valve piston 20 exhibits for example the same cylindrical cross-section on the whole of its external circumference, with the exception of the widening 28. In order to guide the pressure fluid onto the rear side of the valve piston 20, the valve piston 20 comprises a supply 24—axially behind the piston outlet 23 as viewed from the housing inlet 22—which is formed by a plurality of passage channels in a base of the valve piston 20 which are distributed around the central axis R. The widening 28 and correspondingly the housing portion 18 are dimensioned such that the increase in the projection area $F_{28}$ facing the setting member 15 which is provided by the widening 28 at least predominantly equalises the cross-sectional area $F_{25}$ of the coupling member 25 which is "lost" to compensating. The compensating area is an external annular area of the projection area $F_{28}$. The additional projection area which axially faces the axially facing closure wall 11—the compensating area of the widening 28—is preferably exactly as large as the cross-sectional area $F_{25}$ over which the coupling member 25 protrudes through the axially facing closure wall 11. The result of this is that the first axial force which acts in the direction of the setting member 15 is compensated for by the opposing second axial force, and a resultant axial thrust cannot arise. The projection areas, which each generate an axial force when fluid flows through the valve piston 20, are of equal size in both axial directions.

The widening 28 is formed at the axially facing end of the valve piston 20 which faces the setting member 15, as is preferred. The widened housing portion 18 exhibits a sufficient axial extent to enable the adjusting movements of the valve piston 20. The widening 28 forms the end of the recess 27 which faces the setting member 15. The widened housing portion 18 tapers at 13 onto the narrower cross-section which is constant in the subsequent axial profile. The taper 13 is formed within the recess 27, axially for example in the region of the reservoir port $T_B$.

The phase setter comprises a locking means 30 which, in a locking engagement, mechanically fixes the rotor 7 in a particular rotational angular position relative to the stator 3. For example, it fixes the rotor 7 in the early setting, as is preferred. It is however also possible to mechanically fix the rotor 7 in the late setting or in a setting between the late setting and the early setting. The locking means 30 can be moved out of the locking engagement, into a releasing state, by charging it with the pressure fluid. When the locking means 30 is situated in its releasing state, the rotor 7 can be rotated relative to the stator 3, i.e. the rotational angular position of the rotor 7 relative to the stator 3 can be altered, when either the setting chambers 8 or the setting chambers 9 are charged with pressure and the other setting chambers 9 or 8 in each case are correspondingly relieved of pressure. A minimum unlocking pressure $P_E$ is required for unlocking against a spring force. In preferred embodiments, the minimum unlocking pressure $P_E$ is at most as large as the hot idling pressure $P_{HL}$ in the pressure fluid supply to the phase setter. The hot idling pressure $P_{HL}$ can in particular be measured at a non-return means which is arranged in the pressure fluid supply in the vicinity of the phase setter, in order to prevent the pressure fluid from flowing back away from the phase setter when the pressure in the setting chambers 8 or 9 which are charged with the pressure fluid is higher than the supply pressure immediately upstream of the non-return means. The non-return means can in particular be formed by a reflux valve.

The locking means 30 comprises a locking element 31 which can be axially moved back and forth relative to the stator 3 and the rotor 7, and a locking spring 32 which tenses the locking element 31 in an axial direction into the locking engagement with its spring force. The locking element 31 is supported on the rotor 7 via the locking spring 32 and guided in a guide 36 in one of the rotor vanes 7*a* such that it can be axially moved back and forth. In the locking engagement, it protrudes axially beyond an axially facing side of the relevant rotor vane 7*a*, into an axially opposing receptacle 33 of the stator 3. The receptacle 33 is formed as a recess on an axially facing side of the stator 3 which faces the rotor 7, for example in the cover region of the drive wheel 4. The locking means 30 is connected to one of either the setting chambers 8 or the setting chambers 9 and is preferably connected to one of the early setting chambers 8 only, such that when the corresponding setting chambers are charged with pressure, the locking element 31 is moved out of the locking engagement, against the spring force of the locking spring 32, and the rotor 7 is released from being mechanically fixed. The space in the rotor 7 in which the locking spring 32 is arranged is connected to the low-pressure side of the pressure fluid system via a discharge line 39, such that no counter pressure which would prevent unlocking can build up at the locking element 31 axially opposite the receptacle 33.

Figure 2:
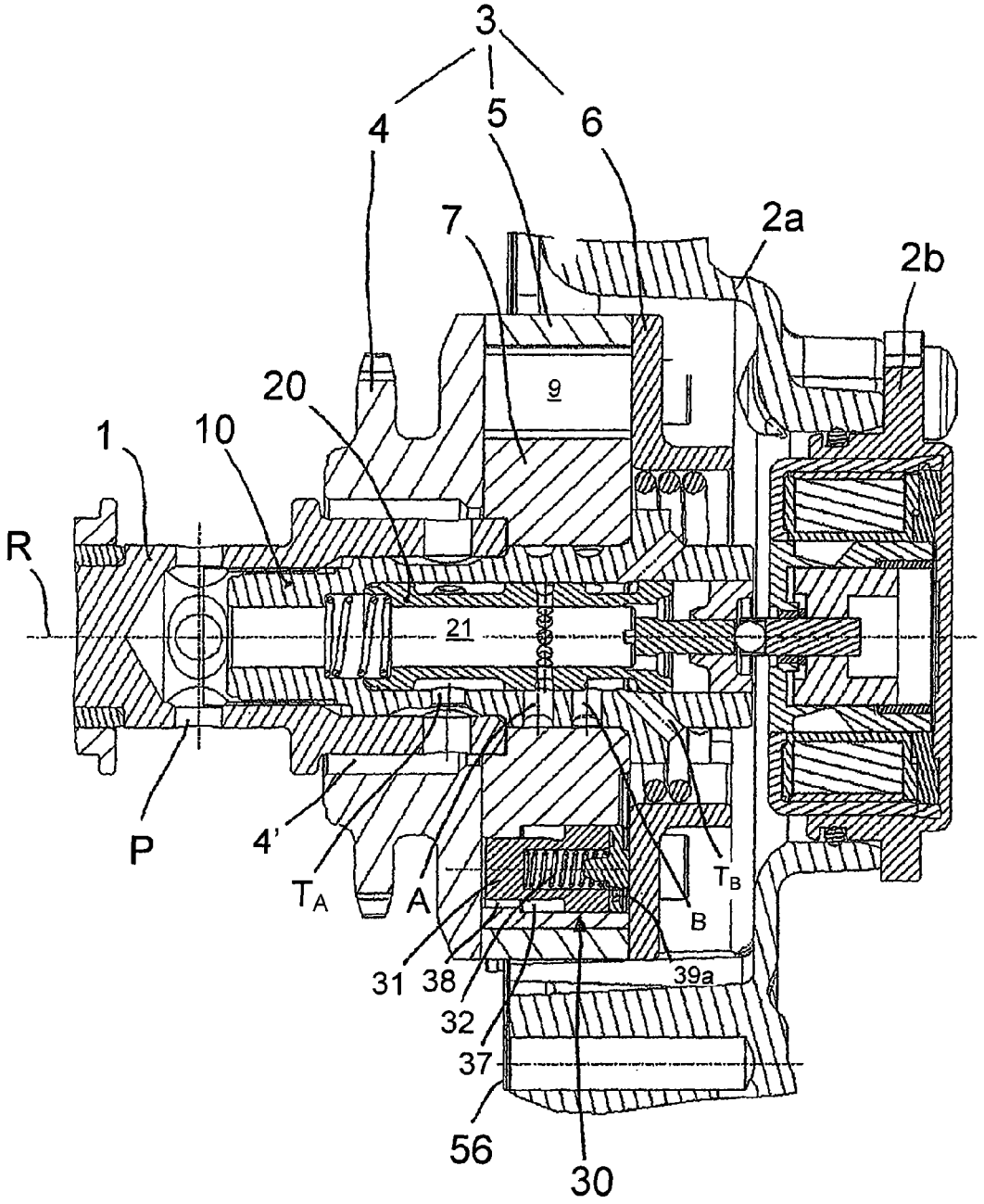
FIG. 2 the cam shaft phase setter, in an unlocked state.

FIG. 2 shows the phase setter in its unlocked state. The minimum unlocking pressure $P_E$ has been reached or exceeded, such that the rotor 7 can be hydraulically adjusted by means of the control valve. The rotor 7 already no longer occupies the early setting.

Figure 4:
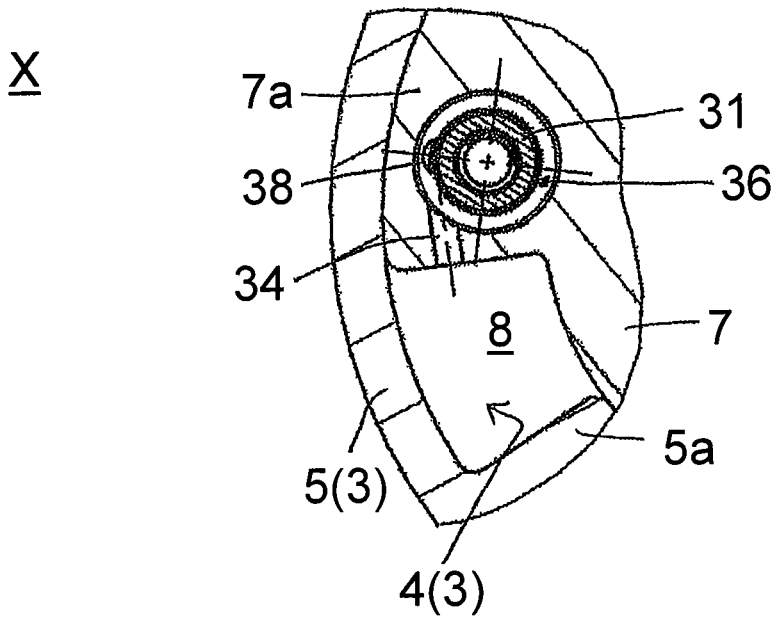
FIG. 4 a locking means of the phase setter in the cross-sectional detail X of FIG. 3*a;*
Figure 5:
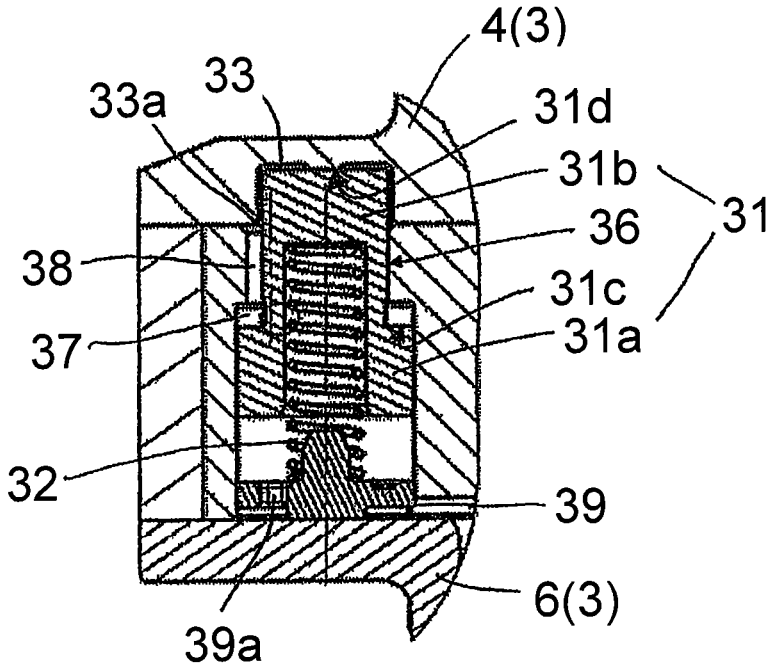
FIG. 5 the locking means in a longitudinal section.

Details of the locking means 30 can be seen from FIGS. 3 to 5. The locking element 31 forms a stepped piston comprising a guiding portion 31*a* which is always guided in the rotor vane 7*a*, and a comparatively slimmer engaging portion 31*b* which engages with the receptacle 33 of the stator 3 in the locking engagement shown in FIG. 5. The locking element 31 comprises a pressure area 31*d* which is situated in the receptacle 33 in the locking engagement, and another pressure area 31*c* which is annular and offset from the pressure area 31*d*. The pressure areas 31*c* and 31*d* act in the same direction. The pressure area 31*c* closes off an annular pressure space 37, which is formed within the rotor vane 7*a*, on an axially facing side. The receptacle 33—more specifically, the space within the receptacle 33 which is delimited by the pressure area 31*d*—is connected, effectively short-circuited, to the pressure space 37 via a connecting channel 38 which is an internal connecting channel in relation to the locking means 30. The connecting channel 38 extends in the rotor vane 7*a* up to the axially facing side of the rotor 7 through a narrower guiding portion of the guide 36 which tightly encompasses the engaging portion 31*b* of the locking element 31, such that the locking element 31 is guided not only in its wider portion 31*a* but also in the engaging portion 31*b*.

The space which is circumferentially delimited by the guide 36 is closed by means of an inserted supporting element 35 at its end which is opposite the receptacle 33 in the locking engagement. One end of the locking spring 32 is supported on the supporting element 35 and the other end is supported on the locking element 31. A venting passage 39*a* is formed in the supporting element 35 and connects the space between the supporting element 35 and the locking element 31 to the continuative discharge line 39 which is connected to the low-pressure side of the pressure fluid supply system, such that no counter pressure which would critically impede unlocking can build up. It may also be remarked with respect to the receptacle 33 that its opening edge 33*a* which faces the rotor vane 7*a* is circumferentially chamfered in order to make it easier to enter the locking engagement, particularly as the locking element 31 is preferably also cylindrical in the engaging portion 31*b*. A certain clearance is also preferably ensured, preferably in an extension of the connecting channel 38, in order to create a connection, which exhibits as little loss as possible, between the pressure space 37 and the other pressure space which is delimited by the pressure area 31*d*. A flat, raised projection is formed in the receptacle 33, as is preferred but merely optional, wherein the pressure area 31*d* abuts said projection in the locking engagement, such that a certain residual volume for the pressure fluid is available around the projection, even in the locking engagement.

In accordance with the embodiment from FIGS. 3*a* and 4, the locking means 30 is connected for the purpose of unlocking to the nearest early setting chamber 8 by a connecting channel 34. The connecting channel 34 leads from the pressure space 37 through the rotor vane 7*a* directly into the early setting chamber 8 and advantageously short-circuits it to the locking means 30. The pressure chamber 37 is therefore connected to the early setting chamber 8 at a particularly low resistance, such that if there are changes in pressure, the pressure of the early setting chamber 8 is also set, with almost no loss or delay, in the pressure space 37 and—via the internal connecting channel 38—also in the receptacle 33. As soon as the pressure in the early setting chamber 8 has reached the minimum unlocking pressure $P_E$, this pressure also applies—practically with no delay—at the pressure areas 31*c* and 31*d*, such that the locking element 31 is moved out of the locking engagement and the rotor 7 can be adjusted in the direction of the late setting by increasing the pressure in the late setting chambers 9 using the pressure in the early setting chambers 8. Any pressure fluctuations in the early setting chamber 8, which is directly connected to the locking means 30, are even helpful for releasing the locking engagement, since this shakes the locking element 31 free, such that during these vibrations of the rotor 7, the locking element 31 is briefly relieved of the transverse and/or shearing force which acts in the locking engagement due to the drag moment of the cam shaft. In FIG. 3, the rotational direction of the stator 3 is indicated by a rotational direction arrow D. The rotor 7 and the cam shaft 1 which is non-rotationally connected to it are slaved by the drag. A part of the torque is also transmitted in the locking engagement, whereby the transverse force mentioned acts on the engaging portion 31*b* of the locking element 31 in the rotational direction indicated.

In accordance with the modified embodiment from FIG. 3*b*, the locking means 30 is connected for the purpose of unlocking to the nearest late setting chamber 9 by a connecting channel 34. The connecting channel 34 leads from the pressure space 37 through the rotor vane 7*a* directly into the late setting chamber 9 and advantageously short-circuits it to the locking means 30. The pressure chamber 37 is therefore connected to the late setting chamber 9 at a particularly low resistance, such that if there are changes in pressure, the pressure of the late setting chamber 9 is also set, with almost no loss or delay, in the pressure space 37 and—via the internal connecting channel 38—also in the receptacle 33. As soon as the pressure in the late setting chamber 9 has reached the minimum unlocking pressure $P_E$, this pressure also applies—practically with no delay—at the pressure areas 31*c* and 31*d*, such that the locking element 31 is moved out of the locking engagement and the rotor 7 can be adjusted in the direction of the late setting by the pressure or by increasing the pressure in the late setting chambers 9 and lowering the pressure in the early setting chambers 8. Any pressure fluctuations in the late setting chamber 9, which is directly connected to the locking means 30, are even helpful for releasing the locking engagement, since this shakes the locking element 31 free, such that during these vibrations of the rotor 7, the locking element 31 is briefly relieved of the transverse and/or shearing force which acts in the locking engagement due to the drag moment of the cam shaft and the pressure in the late setting chambers 9. In FIG. 3, the rotational direction of the stator 3 is indicated by a rotational direction arrow D. The rotor 7 and the cam shaft 1 which is non-rotationally connected to it are slaved by the drag. A part of the torque is also transmitted in the locking engagement, whereby the transverse force mentioned acts on the engaging portion 31*b* of the locking element 31 in the rotational direction indicated.

As can be seen in FIGS. 3*a*, 3*b* and 4, the internal connecting channel 38 is advantageously arranged in the guide 36, in the shape of a groove, in a region which is a radial region in relation to the rotational axis R, for example on the outside. The circumferential area of the guide 36 required for absorbing the transverse force is thus reduced as little as possible. Arranging the locking means 30 near to the radial end of the rotor vane 7*a* is also advantageous, since this helps to reduce the transverse force which has to be absorbed. For the same drag moment, a more central arrangement nearer to the rotational axis of the rotor 7 would entail a greater transverse force, in accordance with the reduction in the size of the lever.

Arranging the locking means 30 eccentrically in relation to the circumferential direction in the rotor vane 7*a* is advantageous. In this eccentric arrangement, the locking means 30 from FIG. 3*a* is arranged nearer in the circumferential direction to the side area of the rotor vane 7*a* which delimits the early setting chamber 8 than to the side area which lies opposite in the circumferential direction and delimits the late setting chamber 9. In this eccentric arrangement, the locking means 30 from FIG. 3*b* is arranged nearer in the circumferential direction to the side area of the rotor vane 7*a* which delimits the late setting chamber 9 than to the side area which lies opposite in the circumferential direction and delimits the early setting chamber 8. The locking means from FIG. 3*b* can optionally be arranged nearer to the side area of the rotor vane 7*a* which delimits the early setting chamber 8, i.e. as in FIG. 3*a*, but with the connecting channel 34 to the late setting chamber 9. In another option, the locking means from FIG. 3*a* can be arranged nearer to the side area of the rotor vane 7*a* which delimits the late setting chamber 9, i.e. as in FIG. 3*b*, but with the connecting channel 34 to the early setting chamber 8.

If the late setting chamber 9 is charged with pressure in order to adjust the rotor 7 in the late setting direction, a sealing stay which is comparatively long in the circumferential direction is provided between the late setting chamber 9 and the locking means 30 (FIG. 3*a*), in particular on the side of the stator 3 on which the receptacle 33 is arranged. If the early setting chamber 8 is charged with pressure in order to adjust the rotor 7 in the early setting direction, a sealing stay which is comparatively long in the circumferential direction is provided between the early setting chamber 8 and the locking means 30 (FIG. 3*b*), in particular on the side of the stator 3 on which the receptacle 33 is arranged. Since the late setting chamber 9 is preferably charged at high rotational speeds of the engine and therefore charged with higher fluid pressures than the early setting chamber 8, it is preferable to embody comparatively long sealing stays between the late setting chamber 9 and the locking means 30 or to arrange the locking means 30 nearer to the early setting chamber 8.

The rotor vane 7*a* which accommodates the locking element 31 is wider, as measured in the circumferential direction, than the other rotor vanes 7*a*. This creates design space for the locking means 30 and, in conjunction with arranging it eccentrically in the circumferential direction, provides a sealing stay on the axially facing sides of the rotor vanes which is again extended towards the late setting chamber 9 (FIG. 3*a*) or the early setting chamber 8 (FIG. 3*b*). The distance, as measured in the circumferential direction, between the stator vanes 5*a* which are adjacent to the left and right is likewise increased by the increased width of the wider rotor vane 7*a*. Lastly, it may also be noted that the rotor vane 7*a* in which the locking means 30 is formed exhibits a certain distance from the nearest inwardly protruding vane of the impeller 5 in the region of the late setting chamber 9 in the early setting shown in FIGS. 3*a* and 3*b*, such that a certain chamber volume also remains there in the early setting and no significant gap resistances have to be overcome first when charging with pressure.

FIGS. 3*a* and 3*b* also show the short and direct fluid connections 7*b* which lead from the central control valve 10, 20 through the rotor 7 to the setting chambers 8 and/or 9. In the section in FIGS. 3*a* and 3*b*, these are the fluid connections 7*b* to the operating ports A for the late setting chambers 9. The fluid connections which lead from the valve to the early setting chambers 8 are arranged and extend offset, axially and in the circumferential direction, with respect to the fluid connections 7*b*. The fluid connections 7*b* and the fluid connections for the early setting chambers 8 are linear bores which extend at least substantially radially and port into the respective setting chamber 8 and/or 9 at their radially internal ends with respect to the valve housing 10 and at their external ends in the root regions of the rotor vanes 7*a*.

Figure 6:
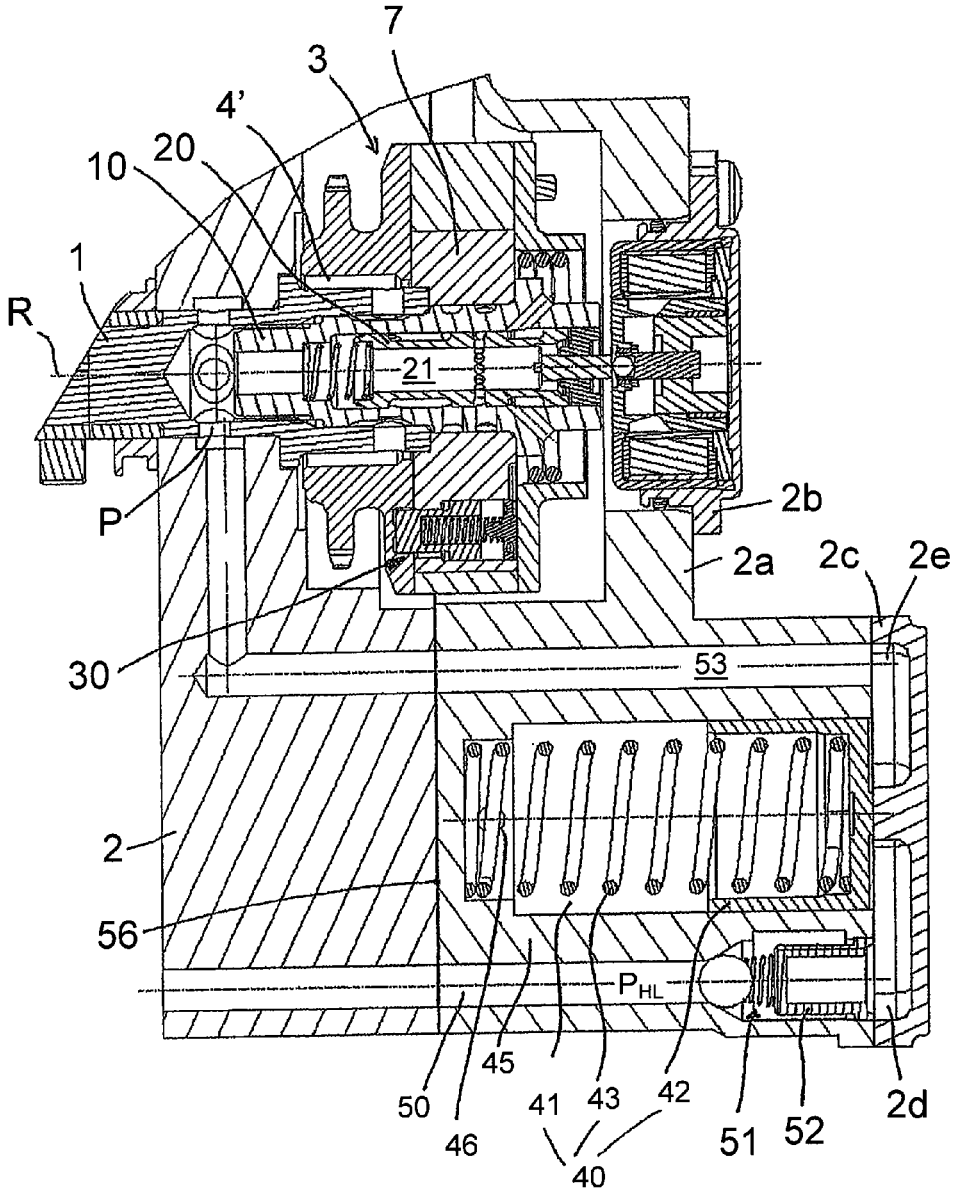
FIG. 6 the phase setter and an assigned pressure storage means, in section.

FIG. 6 shows the phase setter with an assigned pressure storage means 40. The pressure storage means 40 comprises a storage chamber 41 and a movable wall structure 42 which delimits the storage chamber 41 on one side. It also comprises a spring means 43, wherein the wall structure 42 can be moved counter to the restoring spring force of the spring means 43 in order to fill the storage chamber 41. The wall structure 42 is formed as a piston. The spring means 43 consists of a single mechanical spring, for example a helical spring which is pressurised when the storage chamber 41 is charged, as is preferred. The wall structure 42 can be freely moved back and forth, such that its chamber pressure is always available with no delay when the chamber is at least partially filled.

The pressure storage means 40 is arranged in the flow path of the pressure fluid to the phase setter, upstream of the control valve 10, 20. The phase setter is connected to the pressure fluid supply system via a supply channel 50. A non-return means 51, for example a reflux valve, is arranged in the supply channel 50, upstream of the phase setter and the pressure storage means 40, and prevents pressure fluid from flowing back. A filter element 52 is also arranged in the supply channel 50, between the non-return means 51 and the storage chamber 41. If the fluid pressure immediately upstream of the non-return means 51 in the supply system exceeds the pressure between the non-return means 51 and the phase setter—in the arrangement selected, the pressure in the storage chamber 41—then the non-return means 51 opens in the direction of the pressure storage means 40, such that the latter can be partially or completely filled in accordance with the pressure and the restoring spring force of the spring means 43. The maximum filling volume is reached when the wall structure 42 abuts against an abutment of the pressure storage means 40. The storage chamber 41 is connected to the phase setter over a short path via a continuative downstream supply channel 53. In the example embodiment, the connection is established via the cam shaft 1. A drainage channel 46 ensures that the storage chamber 41 can be filled without any significant counter pressure. The drainage channel 46 connects the space on the rear side of the movable wall structure 42 to the low-pressure side of the pressure fluid supply system.

An open side of the storage chamber 41 is covered by a cover 2*c*. On the one hand, the cover 2*c* forms an abutment for the piston 42, as is preferred but merely by way of example, and on the other hand forms an inlet 2*d* which leads directly into the storage chamber 41 and an outlet 2*e* which leads directly out of the storage chamber 41, as is preferred but likewise merely by way of example. The storage chamber 41 is connected to the supply channel 50 via the inlet 2*d* and to the downstream supply channel 53, which leads to the phase setter, via the outlet 2*e*. The pressure storage means 40 is arranged in a main flow of the pressure fluid which leads to the phase setter, wherein the pressure fluid which is for example supplied via the machine housing 2 and the connected supply channel 50 only passes into the supply channel 53, which leads on to the phase setter, and from the supply channel 53 to the pressure port P, for example again via the machine housing 2, via the pressure storage means 40 by flowing through the storage chamber 41.

The area of the wall structure 42 which is charged with the pressure fluid in the storage chamber 41, and the spring resilience and optionally a spring bias of the spring means 43 which exists without charging it with pressure, are attuned to the system pressure in the pressure fluid supply system, such that the storage chamber 41 begins to fill at the latest when the hot idling pressure $P_{HL}$ is reached in the pressure fluid supply system. The start-of-filling pressure $P_{FB}$ is the pressure at which the filling process begins, i.e. at which the wall structure 42 is moved counter to the restoring spring force of the spring means 43 and an increase in the filling volume as compared to a minimum volume of the storage chamber 41 begins. The minimum volume can be zero, but in practice, the storage chamber 41 will comprise a certain residual volume in its initial state. The start-of-filling pressure $P_{FB}$ is at most as large as the hot idling pressure $P_{HL}$ and preferably smaller. The pressure storage means 40 is therefore active even at low system pressures.

The pressure storage means 40 is also configured such that the process of filling the storage chamber 41 is not already complete when the pressure in the storage chamber 41 corresponds to the hot idling pressure $P_{HL}$, i.e. at the idling rotational speed, but rather only at a higher filling pressure. The pressure storage means 40 thus always operates at an adapted equalising pressure and/or storage pressure, from hot idling—preferably even at a lower rotational speed than the idling rotational speed—up to a rotational speed which is above the idling rotational speed. The pressure storage means 40 is preferably attuned such that the storage chamber 41 reaches its maximum filling volume at twice the idling rotational speed at the earliest, more preferably at three times the idling rotational speed at the earliest. As in the example embodiment, the maximum filling volume can be delimited in absolute terms by an abutting contact; a delimiting abutment is not however needed in principle. In alternative embodiments, the pressure storage means 40 can also be filled or emptied in accordance with the respective system pressure over the entire rotational speed range of the combustion engine. Filling over the entire rotational speed range is not however required and not even always desirable, since the spring means 43 is subject to limitations with regard to its spring resilience. Such limitations can be countered by connecting a plurality of spring members in series or parallel, for example one spring member exhibiting a low spring resilience and one comparatively more rigid spring member, wherein the weaker spring member would primarily be tensed in the lower rotational speed range, and the more rigid spring member would only be tensed to a relevant extent or even at all at a higher rotational speed.

The locking means 30 is attuned to the system pressure, by correspondingly configuring the pressure areas 31*c* and 31*d* of the locking element 31 and the spring resilience or a spring bias of the locking spring 32, such that the minimum unlocking pressure $P_E$ is likewise at most as large as and preferably smaller than the hot idling pressure $P_{HL}$. The minimum unlocking pressure $P_E$ is even more preferably at most as large as and preferably smaller than the start-of-filling pressure $P_{FB}$. The comparatively low minimum unlocking pressure $P_E$ ensures that the phase setter is unlocked in good time, at low rotational speeds of the combustion engine, and therefore also that the rotor can be adjusted even at a correspondingly low rotational speed. Unlocking in this sensitive way is accommodated if the locking means 30 is unlocked at the pressure which prevails in the early setting chamber 8 (FIG. 3*a*), wherein charging the two pressure areas 31*c* and 31*d* at the same time has an additional beneficial effect, since the spring force of the locking spring 32 can then be selected to be correspondingly large, which leads to a secure locking engagement.

With respect to the pressures which are critical to attuning, it may also be added that the hot idling pressure $P_{HL}$ can in particular be measured near to the non-return means 51, in particular upstream of the non-return means 51. The start-of-filling pressure $P_{FB}$ and the minimum filling pressure for complete filling, if complete filling is predefined by an abutting contact, can be measured at the same point, wherein this of course presumes that at the time of measuring, the pressure in the storage chamber 41 is not currently greater than the pressure downstream of the non-return means 51. Lastly, the minimum unlocking pressure $P_E$ can also be measured at this point. The locking engagement should be released when the minimum unlocking pressure $P_E$ is reached at said point. When measuring the pressures which are to be compared to each other, care should however be taken that the pressure at the measuring location is at least substantially constant, i.e. that pressure fluctuations which are to be compensated for by the pressure storage means 40 do not currently obtain. The combustion engine should therefore be operated in a stationary operational state while measurements are being taken. This does not include unavoidable higher-frequency pressure fluctuations such as occur due to delivery pulsations of the pressure fluid pump and conduit oscillations in the pressure fluid system, even in the stationary operational state. These higher-frequency pressure fluctuations result in an average pressure value which is respectively representative for comparison purposes and do not significantly influence the setting speed of the phase setter for practical purposes.

Figure 7:
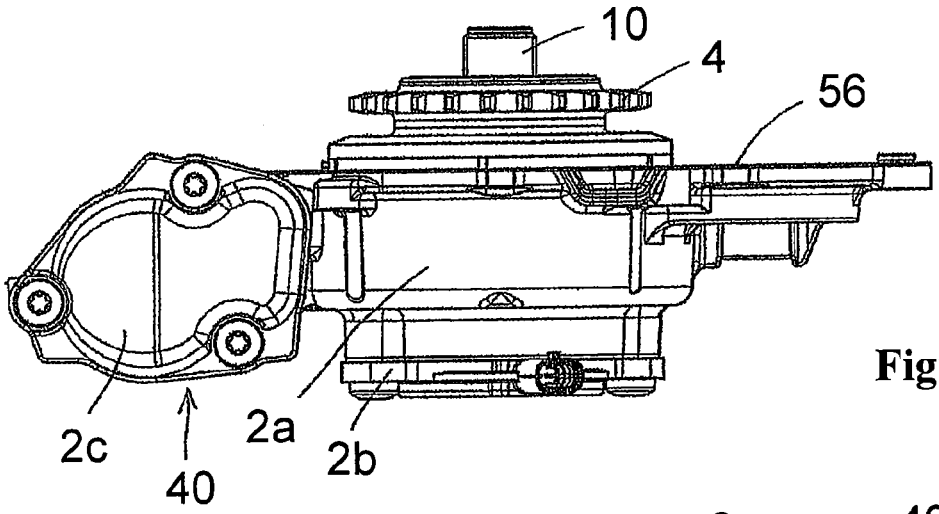
FIG. 7 an attachment housing in which the cam shaft phase setter is arranged together with the pressure storage means.

FIG. 7 shows the attachment housing which comprises the attachment housing part 2*a* and the covers 2*b* and 2*c* and accommodates the phase setter—substantially the stator 3, the rotor 7 and the central control valve—and from which the valve housing 10 protrudes on the mounting side of the attachment housing 2*a*, 2*b*, 2*c*. The attachment housing, for example the attachment housing part 2*a*, also directly includes the pressure storage means 40, i.e. it combines the phase setter and the pressure storage means 40 to form a mounting unit. This mounting unit is mounted on the machine housing of the combustion engine, for example on a cylinder head housing, while the cover 2*b* is removed, and the cover 2*b* is attached to the housing part 2*a* once the mounting unit has been mounted. The non-return means 51 is advantageously likewise arranged in the attachment housing 2*a*, 2*b*, 2*c*.

Figure 8:
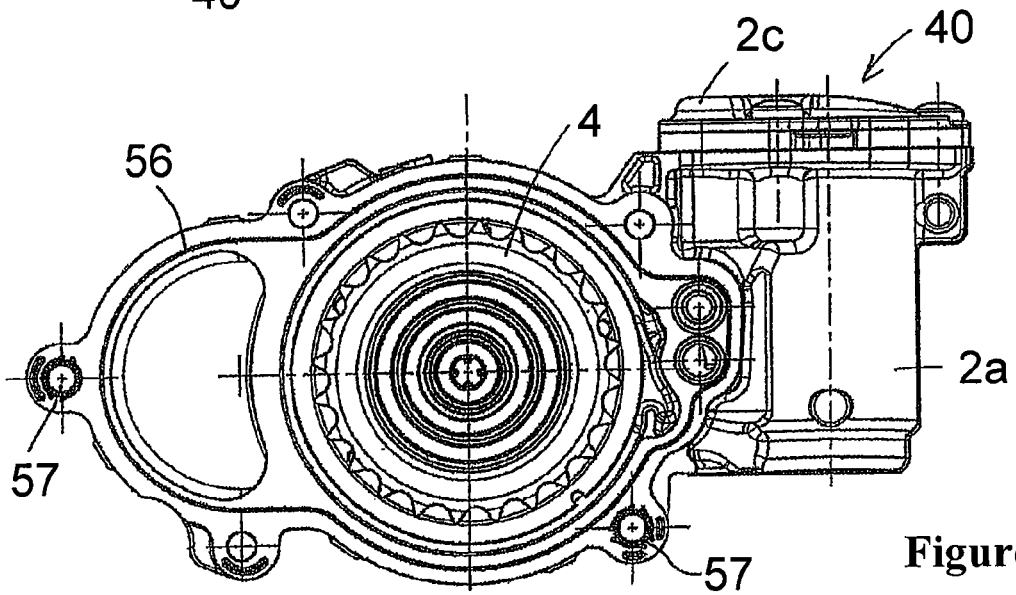
FIG. 8 the attachment housing, with a gasket arranged on a mounting side.

FIG. 8 shows the attachment housing 2*a*, 2*b*, 2*c* in an axially facing view onto the mounting side. A gasket 56 is arranged on the mounting side and, when mounted, ensures that the machine housing and the attachment housing 2*a*, 2*b* are sealed off from each other. On the mounting side, centring elements 57 protrude beyond the gasket 56, towards the machine housing in relation to the mounted state, and when mounted protrude into complementary centring counter structures of the machine housing. The centring elements 57 are for example pin-shaped and can be hollow in cross-section and formed as centring sleeves in such embodiments. The centring elements 57 are not only used for centring the mounting unit and thus making it easier to mount, but also hold the gasket 56 on the mounting side of the attachment housing 2*a*, 2*b* in a position which is directly suitable for mounting, by way of a holding engagement in which for example the gasket 56 grips behind at least one of the centring elements 57, preferably a plurality of the centring elements 57 or all of the centring elements 57. In the holding engagement, the gasket is connected captively to the attachment housing.

Figure 9:
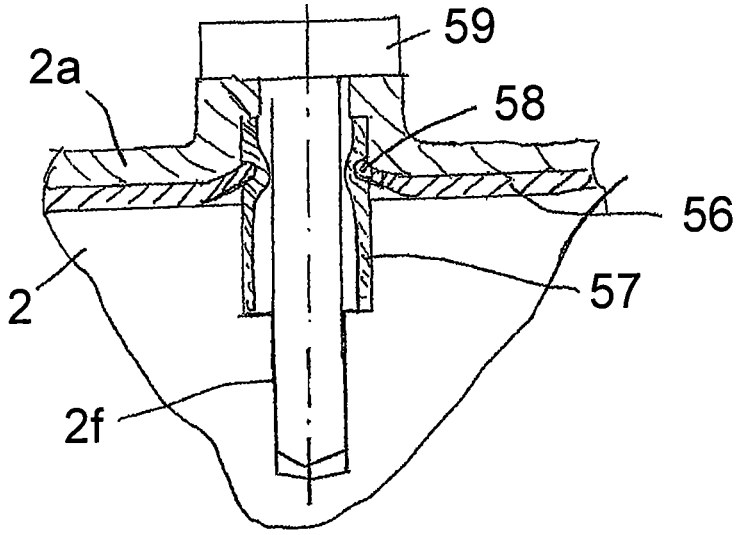
FIG. 9 a detail of the gasket.

FIG. 9 shows one such rear grip which is representative of preferably one or more other such rear grips. The centring element 57 shown protrudes through an opening in the gasket 56. The centring element 57 is inserted into the attachment housing 2*a*, 2*b*, is fixedly held in a corresponding receptacle, and protrudes slightly beyond the axially facing area of the attachment housing 2*a*, 2*b*, as mentioned. It is tapered in the protruding portion near to the axially facing area, such that the opening edge 58 of the gasket 56 which surrounds the centring element 57 engages with the taper, and the rear grip which holds the gasket 56 is thus formed. The taper can be replaced with another shaped element for the holding engagement, for example a projection such as for example a flange. In the example embodiment, the functions of centring the attachment housing 2*a*, 2*b*, holding the gasket 56 and providing the actual joining connection between the attachment housing 2*a*, 2*b* and the machine housing are concentrated within a minimum space, by guiding a tensing element 59 of the joining connection, for example a screw, through the hollow centring element 57. When mounted, the tensing element 59 protrudes through the centring element 57, and the portion of the tensing element 59 which protrudes beyond the centring element 57 is connected to the machine housing, for example in a screw engagement 2*f*.

LIST OF REFERENCE SIGNS

1 cam shaft
1*a* accommodating space
2 pivot bearing, machine housing
2*a* housing part
2*b* cover
2*c* cover of the storage chamber
2*d* inlet of the storage chamber
2*e* outlet of the storage chamber
2*f* screw engagement
3 stator
4 drive wheel
4' feedback
5 impeller
5*a* vane
6 cover
7 rotor
7*a* vane
8 early setting chamber
9 late setting chamber
10 valve housing
11 axially facing closure wall
12 screw connection
13 —
14 spring member
15 setting member
16 coil
17 anchor

18 widened housing portion
19 —
20 valve piston
21 hollow space
22 piston inlet
23 piston outlet
24 compensating supply
25 coupling member
26 recess
27 recess
28 widening, widened piston portion
29 —
30 locking means
31 locking element
31*a* guiding portion
31*b* engaging portion
31*c* first pressure area
31*d* second pressure area
32 locking spring
33 receptacle
33*a* edge of the receptacle
34 external connecting channel
35 supporting element
36 guide
37 pressure space
38 internal connecting channel
39 discharge line
39*a* passage
40 pressure storage means
41 storage chamber
42 wall structure, piston
43 spring means
44 axially facing wall
45 circumferential wall
46 drainage channel
47 —
48 —
49 —
50 supply channel
51 non-return means
52 filter element
53 supply channel
54 —
55 —
56 gasket
57 centring element
58 opening edge
59 tensing element
A operating port
B operating port
D rotational direction
P pressure port
$P_a$ axial housing inlet
$P_r$ radial housing inlet
$P_E$ minimum unlocking pressure
$P_{FB}$ start-of-filling pressure
$P_{HL}$ hot idling pressure
R rotational axis, central axis
$T_A$ reservoir port
$T_B$ reservoir port

The invention claimed is:

1. A device for adjusting the rotational angular position of a cam shaft relative to a crankshaft of a combustion engine, said device comprising:

(a) a stator which can be rotary-driven by the crankshaft in a fixed rotational speed relationship;

(b) a rotor which can be rotary-driven by the stator and can be coupled to the cam shaft in order to rotary-drive the cam shaft;

(c) an early setting chamber for generating a first torque which acts on the rotor relative to the stator in a leading direction, and a late setting chamber for generating a second torque which acts on the rotor relative to the stator in a trailing direction, wherein in order to generate the first torque or the second torque, the early setting chamber and the late setting chamber can be charged with a pressure fluid, wherein when a rotational speed of the crankshaft rises, a pressure of the pressure fluid likewise rises, in order to be able to adjust the rotational angular position of the rotor relative to the stator;

(d) a supply branch for supplying the pressure fluid to the setting chambers and a drainage branch for draining the pressure fluid from the setting chambers;

(e) and a pressure storage means which is arranged in the supply branch and comprises a spring means and a storage chamber which can be filled with the pressure fluid against a restoring spring force of the spring means, wherein the spring means is formed by at least one spring member which is a mechanical spring;

(f) wherein the storage chamber begins to fill, against the spring force, at a start-of-filling pressure which is at most as large as a hot idling pressure which the pressure fluid exhibits when the combustion engine is idling in its hot operational state, (g) and wherein filling of the storage chamber is completed only if the pressure of the pressure fluid exceeds the hot idling pressure, wherein the pressure storage chamber is able to resupply the pressure fluid at a pressure above the hot idling pressure.

2. The device according to claim 1, further comprising a locking means which, in a locking engagement, mechanically fixes the rotor in a particular rotational angular position relative to the stator and switches to a releasing state, which allows the rotational angular position of the rotor to be adjusted, when it is charged with the pressure fluid and the pressure of the pressure fluid has reached a minimum unlocking pressure which is at most as large as the hot idling pressure or the start-of-filling pressure.

3. The device according to claim 1, wherein the pressure storage means is configured, based on a volume and cross-sectional area of the storage chamber and the spring force, such that the setting speed at which the rotational angular position of the rotor is adjusted relative to the stator is adapted to a frequency of the combustion cycles of the combustion engine up to at least one and a half times an idling rotational speed of the combustion engine, even when there is currently a drop in pressure in the part of the supply branch for the pressure fluid which is located upstream of the pressure storage means, by resupplying from the pressure storage means, such that the ratio of the setting speed and the crankshaft rotational speed is at least substantially constant up to at least one and a half times the idling rotational speed.

4. The device according to claim 1, further comprising a locking means which, in a locking engagement, mechanically fixes the rotor in a particular rotational angular position relative to the stator and, when it is charged with the pressure fluid, switches to a releasing state which allows the rotational angular position of the rotor to be adjusted, wherein in order to release the locking engagement, the locking means is connected to at least one of the late setting chamber and to the early setting chamber.

5. The device according to claim 1, further comprising a locking means which comprises a locking spring and a locking element which, when it is charged with the pressure fluid, can be moved against a restoring spring force of the locking spring out of a locking engagement, in which it mechanically fixes the rotor in a particular rotational angular position relative to the stator, into a releasing position in which it allows the relative rotational angular position of the rotor to be adjusted.

6. The device according to claim 5, wherein the locking element is supported on one of the rotor and the stator via the locking spring and is guided by said one of the rotor and the stator such that it can be moved back and forth between the locking engagement and the releasing position.

7. The device according to claim 5, wherein in the locking engagement, an engaging portion of the locking element engages with a receptacle which is formed in one of the stator and the rotor, and comprises an annular first pressure area which is situated outside the receptacle in the other of the stator and the rotor when the locking engagement is established, and a second pressure area which is situated in the receptacle when the locking engagement is established, wherein the pressure areas can each be charged with the pressure fluid in order to release the locking engagement and are connected to each other, such that in order to release the locking engagement, the pressure fluid passes to one of the pressure areas and from there also to the other of the pressure areas.

8. The device according to claim 5, wherein the rotor mounts the locking element such that it can be moved, and comprises a connecting channel which is an external connecting channel in relation to the locking means and which ports into one of the setting chambers, and connects the locking means to said setting chamber in order to release the locking engagement.

9. The device according to claim 5, wherein the locking element is arranged in a vane of the rotor, such that it can be moved and eccentrically in the circumferential direction as viewed in an axially facing view of the rotor or nearer to the late setting chamber or nearer to the early setting chamber.

10. The device according to claim 5, wherein the locking element is arranged in a vane of the rotor, such that it can be axially moved and nearer to a radial end of the vane than to the rotational axis of the rotor.

11. The device according to claim 5, further comprising a non-return means which is arranged in the supply branch, upstream of the pressure storage means, and allows the pressure fluid to be supplied to the setting chambers and the pressure storage means but prevents it from flowing back.

12. The device according to claim 1, wherein the phase setter is configured to be mounted on an axial end of the cam shaft and comprises a control valve which when mounted is a central control valve in relation to the rotational axis of the cam shaft or the arrangement of the stator and the rotor and which comprises an axial inlet for axially charging a valve piston of the control valve, which can be moved back and forth, with the pressure fluid; and the pressure storage means comprises an inlet for the pressure fluid which can be connected to the supply branch, and an outlet which is adapted to be connected to the control valve wherein the inlet is provided in addition to the outlet for arranging the pressure storage means in a main flow to the control valve or can also form the outlet for arranging the pressure storage means in a secondary flow, branched off from the main flow.

13. The device according to claim 1, wherein the stator, the rotor and the pressure storage means are arranged in an attachment housing which is adapted to be mounted on the combustion engine, wherein the attachment housing forms at least one chamber wall of the storage chamber, and the phase setter comprises a control valve which is a central control valve with respect to the stator and the rotor and which comprises a valve piston which can be axially charged with the pressure fluid.

14. The device according to claim 1, wherein the phase setter comprises a control valve which is a central control valve with respect to the stator and the rotor, comprises a valve housing which is connected, fixed in terms of torque, to the rotor, and comprises a valve piston which is adapted to move back and forth axially in the valve housing and can be axially charged with the pressure fluid; the stator, the rotor and the control valve are combined to form a mounting unit and are arranged in an attachment housing which is adapted to be mounted on the combustion engine; and the valve housing is connected, fixed in terms of torque, to the cam shaft at an axial end of the cam shaft or is configured to be mounted, fixed in terms of torque, in or on the cam shaft.

15. The device according to claim 1, wherein the device is mounted on the combustion engine and is connected to a lubricating oil system of the combustion engine by the supply branch and the drainage branch.

16. The device according to claim 13 wherein a gasket which surrounds a rotational axis of the stator and the rotor is captively held on a mounting side of the attachment housing in a positive fit or a frictional fit by means of at least one centring element which preferably protrudes from a joining area of the attachment housing which surrounds the rotational axis.

17. The device according to claim 1, wherein the spring means comprises a plurality of spring members which jointly generate the restoring spring force which has to be overcome in order to fill the storage chamber.

18. The device according to claim 1 further comprising at least one of the following features:

(i) the spring means exhibits a progressive spring characteristic curve;

(ii) a spring characteristic curve of the spring means rises at a lower pitch below the hot idling pressure than once the hot idling pressure has been exceeded, such that a partial volume of the storage chamber which is filled with the pressure fluid grows, when the pressure of the pressure fluid is increased, more sharply below the hot idling pressure than once the hot idling pressure has been exceeded;

(iii) the pressure storage means is configured such that at the hot idling pressure, a maximum volume of the storage chamber is only predominantly filled with the pressure fluid;

(iv) the spring means exhibits a linear spring characteristic curve;

(v) the spring means exhibits a progressive spring characteristic curve;

(vi) a spring characteristic curve of the spring means rises at a greater pitch below the hot idling pressure than once the hot idling pressure has been exceeded, such that a partial volume of the storage chamber which is filled with the pressure fluid grows, when the pressure of the pressure fluid is increased, more sharply once the hot idling pressure has been exceeded than below the hot idling pressure;

(vii) the pressure storage means is configured such that a maximum volume of the storage chamber is only predominantly filled with the pressure fluid only once the hot idling pressure has been exceeded.

19. The device according to claim 14, wherein a gasket which surrounds a rotational axis of the stator and the rotor is captively held on a mounting side of the attachment housing in a positive fit or a frictional fit by means of at least one centring element which preferably protrudes from a joining area of the attachment housing which surrounds the rotational axis.

20. The device according to claim 7, wherein the pressure areas are connected to each other via a connecting channel which is an internal connecting channel with respect to the locking means, such that in order to release the locking engagement, the pressure fluid passes to one of the pressure areas and from there also to the other of the pressure areas via the internal connecting channel.

21. The device according to claim 8, wherein the one of the setting chambers is the late setting chamber or the early setting chamber.

22. The device according to claim 17, wherein the spring members are arranged such that they are connected in parallel.

23. A device for adjusting the rotational angular position of a cam shaft relative to a crankshaft of a combustion engine, said device comprising:

(a) a stator which can be rotary-driven by the crankshaft in a fixed rotational speed relationship;

(b) a rotor which can be rotary-driven by the stator and can be coupled to the cam shaft in order to rotary-drive the cam shaft;

(c) an early setting chamber for generating a first torque which acts on the rotor relative to the stator in a leading direction, and a late setting chamber for generating a second torque which acts on the rotor relative to the stator in a trailing direction, wherein in order to generate the first torque or the second torque, the early setting chamber and the late setting chamber can be charged with a pressure fluid, wherein when a rotational speed of the crankshaft rises, a pressure of the pressure fluid likewise rises, in order to be able to adjust the rotational angular position of the rotor relative to the stator;

(d) a supply branch for supplying the pressure fluid to the setting chambers and a drainage branch for draining the pressure fluid from the setting chambers;

(e) and a pressure storage means which is arranged in the supply branch and comprises a spring means and a storage chamber which can be filled with the pressure fluid against a restoring spring force of the spring means, wherein the spring means is formed by at least one spring member which is a mechanical spring;

(f) wherein the storage chamber begins to fill, against the spring force, at a start-of-filling pressure which is at most as large as a hot idling pressure which the pressure fluid exhibits when the combustion engine is idling in its hot operational state, (g) and wherein filling of the storage chamber is completed only if the pressure of the pressure fluid within the pressure storage chamber exceeds the hot idling pressure, wherein the pressure storage chamber is able to resupply the pressure fluid at a pressure above the hot idling pressure.

* * * * *